US007773913B2

(12) United States Patent
Ishida

(10) Patent No.: US 7,773,913 B2
(45) Date of Patent: Aug. 10, 2010

(54) IMAGE FORMING APPARATUS

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 538 days.

(21) Appl. No.: 11/854,484

(22) Filed: Sep. 12, 2007

(65) Prior Publication Data

US 2008/0063415 A1 Mar. 13, 2008

(30) Foreign Application Priority Data

Sep. 13, 2006 (JP) ..... 2006-248127

(51) Int. Cl.
*G03G 15/30* (2006.01)

(52) U.S. Cl. ..... 399/149

(58) Field of Classification Search ..... 399/149
See application file for complete search history.

(56) References Cited

U.S. PATENT DOCUMENTS 6,421,512 B2 7/2002 Watanabe
6,952,546 B2 10/2005 Yoshikawa

FOREIGN PATENT DOCUMENTS

| | | |
|---|---|---|
| JP | 06-324565 | 11/1994 |
| JP | 2001-215798 | 8/2001 |
| JP | 2001-215799 | 8/2001 |
| JP | 2004-117960 | 4/2004 |

*Primary Examiner*—David M Gray
*Assistant Examiner*—Andrew V Do
(74) *Attorney, Agent, or Firm*—Canon USA Inc IP Div

(57) ABSTRACT

An image forming apparatus includes first and second image forming units each including a charging device and a development device using a developer including a mixture of toner and carrier, a transfer device for serially transferring toner images onto a transfer medium, a replenishment device for replenishing a replenishing developer including a mixture of toner and carrier to each development device, and a discharge device for discharging the developer. The second image forming unit is disposed on a downstream side of the first image forming unit in a transfer medium travel direction. Each development device of the first and second image forming units is configured to recover a residual transfer toner remaining on each image bearing member. A weight percent of carrier in the replenishing developer to be replenished to the development device of the second image forming unit is larger than that of the first image forming unit.

6 Claims, 9 Drawing Sheets

IMAGE FORMING APPARATUS

BACKGROUND OF THE INVENTION

1. Field of the Invention

The present invention relates to an image forming apparatus. More particularly, the present invention relates to an electrostatic recording type image forming apparatus and an electrophotographic image forming apparatus, such as a copying machine or a laser beam printer, configured to develop an electrostatic image formed on an image bearing member with a developer, which is a mixture of toner and carrier.

2. Description of the Related Art

A conventional electrophotographic image forming apparatus, such as a copying machine, a printer, or a facsimile machine, includes the following components to perform respective operations:

an electrophotographic photosensitive member, which is a rotational drum-like image bearing member;

a charging device configured to evenly charge the photosensitive member to a predetermined polarity and potential;

an exposure device, which is an information writing unit, configured to form an electrostatic latent image on the charged photosensitive member;

a development device configured to visualize, as a developer image (toner image), the electrostatic latent image formed on the photosensitive member, using a developer (toner);

a transfer device configured to transfer the toner image from a surface of the photosensitive member onto a recording material, such as paper;

a cleaning device configured to clean the surface of the photosensitive member by removing a small amount of toner remaining on the surface of the photosensitive member after the transfer (residual developer or residual transfer toner); and a fixing device configured to fix the toner image to the recording material.

The toner remaining on the photosensitive member after the transfer process is removed from the surface of the photosensitive member by the cleaning device. Then, the removed toner is recovered into the cleaning device as waste toner. In view of environmental protection and effective utilization of resources, the market has desired that image forming apparatuses generate no waste toner.

In this regard, a conventional image forming apparatus is configured to return residual transfer toner (waste toner) recovered in a cleaning device to a development device to recycle the waste toner.

Japanese Patent Application Laid-Open No. 2004-117960 (corresponding to U.S. Pat. No. 6,952,546) discusses a cleanerless type image forming apparatus that can remove residual transfer toner remaining on a photosensitive member after transfer from the photosensitive member with a development device by "development-concurrent cleaning" to recover and recycle the toner.

The development-concurrent cleaning is a processing operation for recovering residual transfer toner remaining on a photosensitive member after transfer into a development device at the time of a next development operation. A photosensitive member having residual transfer toner thereon is then charged and exposed to form an electrostatic latent image. Then, in the development-concurrent cleaning, during processing for developing an electrostatic latent image, residual transfer toner existing on a non-image portion, of the residual transfer toner remaining on the surface of the photosensitive member, is removed and recovered into the development device with a fog removing bias.

The "fog removing bias" is a fog removing potential difference (Vback), which is a potential difference between a direct-current voltage applied to a development device and a surface potential of a photosensitive member.

With the conventional method discussed in Japanese Patent Application Laid-Open No. 2004-117960, residual transfer toner is recovered to a development device to be recycled for developing an electrostatic latent image in a next operation. Thus, waste toner can be reduced or suppressed, and an operator's trouble in maintenance of an image forming apparatus can be saved.

In addition, since the image forming apparatus discussed in Japanese Patent Application Laid-Open No. 2004-117960 is a cleanerless type apparatus, the surface of a photosensitive member is not worn or torn by a cleaner. Thus, the coating thickness of the surface of a photosensitive member can be maintained sufficiently thick. Accordingly, the life of a photosensitive member can be prolonged. The cleanerless configuration is also useful in downsizing the entire image forming apparatus.

In a case where a cleanerless type image forming apparatus employing the above-described development-concurrent cleaning uses a contact charging device, which is a charging device that contacts a photosensitive member to charge the surface of a photosensitive member, the following phenomenon can occur.

In this regard, a toner whose charge polarity is reversed against a normal polarity, of residual transfer toner, may adhere to the contact charging device when the residual transfer toner remaining on a photosensitive member passes through a contact nip portion (charging portion) between the photosensitive member and the contact charging deice. This phenomenon may cause an excessive toner contamination on the contact charging device, which may further cause a charging failure.

More specifically, a toner (developer) includes a very small amount of toner whose polarity is essentially reversed against a normal polarity. In addition, a normal polarity toner may be reversed into an antipolarity toner. Furthermore, a charge-eliminated toner may have a small amount of charge.

That is, a residual transfer toner may include a normal polarity toner, an antipolarity toner, and a toner having a small amount of charge. Among these toners, an antipolarity toner or a toner having a small amount of charge may adhere to a contact charging device when passing through a contact nip portion between a photosensitive member and the contact charging device.

In order to remove and recover residual transfer toner remaining on a photosensitive member by the above-described development-concurrent cleaning, it is required that the residual transfer toner remaining on the photosensitive member to be recovered to a development device has a normal polarity and an amount of charge large enough to develop an electrostatic latent image with the development device.

An antipolarity toner and a toner having a small amount of charge cannot be removed from a photosensitive member or recovered to a development device, which may cause an image failure.

In order to prevent adhesion of a toner on a contact charging device, the following operation is required. That is, it is necessary to charge residual transfer toner remaining on a photosensitive member, in which a normal polarity toner, an antipolarity toner, and a toner having a small amount of charge mixedly exist, into a normal polarity. Furthermore, it is necessary to make the toner have a uniform amount of charge.

In this regard, a conventional image forming apparatus has two different auxiliary charging means, namely, a toner charge amount control means and a residual transfer toner uniformizing means (residual toner uniformizing means). The toner charge amount control means is disposed upstream of a contact charging device and downstream of a transfer means as viewed in the direction of rotation of a photosensitive member, and charges residual transfer toner. The residual toner uniformizing means is disposed upstream of the toner charge amount control means and downstream of the transfer means, and uniformizes residual transfer toner remaining on the photosensitive member.

Japanese Patent Application Laid-Open No. 2001-215798 (corresponding to U.S. Pat. No. 6,421,512) and Japanese Patent Application Laid-Open No. 2001-215799 each discuss a method for addressing the above-described problem by applying a constant level of direct current voltage to the residual toner uniformizing means and the toner charge amount control means.

In the conventional method discussed in Japanese Patent Application Laid-Open No. 2001-215798 and Japanese Patent Application Laid-Open No. 2001-215799, the residual toner uniformizing means uniformizes residual toner remaining on the photosensitive member after transfer, and then the toner charge amount control means charges the uniformized residual transfer toner on the photosensitive member into a normal polarity.

Subsequently, the contact charging device charges the surface of the photosensitive member. Then, the contact charging device charges the residual transfer toner, which has been charged by the toner charge amount control means, to an amount of charge large enough to be removed and recovered with the development device by the development-concurrent cleaning. Then, the charged toner is recovered by the development device.

Recent conventional image forming apparatuses employ a two-component development method, which uses a developer made of a mixture of non-magnetic toner and magnetic carrier. With the two-component development method, an image quality can be more stabilized and the life of an image forming apparatus can be longer than those in the case of using another development method that has been discussed so far.

In the case of using an image forming apparatus having a long life, a developer can be deteriorated after a long use. In this case, a carrier in the toner (developer) may be deteriorated. Thus, it is necessary for an operator of an image forming apparatus to exchange the developer after a long use of the image forming apparatus. In order to reduce a trouble of exchanging a developer, the following conventional image forming apparatuses and methods have been developed and marketed so far.

Japanese Patent Application Laid-Open No. 06-324565 discusses an image forming apparatus whose development devices for colors of black (Bk), yellow (Y), magenta (M), and cyan (C) respectively replenish a developer including a toner in an amount equivalent to the current consumption amount due to the development operation. If too much amount of developer may exist in the development device, the exceeding developer is discharged into a waste developer container, which is disposed externally from the development device.

The excessive developer is discharged at substantially the same time as a replenishment of the developer. Thus, an image forming apparatus can be downsized, the cost of manufacture can be reduced, and characteristics of the entire developer can be stabilized.

Furthermore, with the conventional method described above, an operator of an image forming apparatus does not need to exchange a developer or a development device. Accordingly, an operator can more easily perform maintenance of an image forming apparatus, and the running cost for the image forming apparatus can thus be reduced. Such a method is generally referred to as an "automatic developer exchange system".

Prolonging the life of a photosensitive member and a development device and reduction or suppression of waste toner can be achieved by using the above-described cleanerless type image forming apparatus employing an "automatic developer exchange system". Furthermore, with such an apparatus, frequency of exchange of photosensitive members, a development device, a developer, and a waste toner container can be lowered. Thus, the running cost for the image forming apparatus can be reduced, and maintenance operations by an operator of such an image forming apparatus can be performed at a relatively prolonged time interval.

In recent years, the market has desired a full color image forming apparatus that can operate at a high speed. In order to address market needs, an image forming apparatus employing a tandem image forming method has been developed and marketed.

The full color image forming apparatus employing the tandem image forming method includes a photosensitive member, a charging device, an exposure device, and a development device for each color of yellow, magenta, cyan, and black. With such a configuration, the full color image forming apparatus employing the tandem image forming method can form an image for each unit arranged in tandem. According to the tandem image forming method, images of respective four colors can be individually and simultaneously formed. Thus, an image can be output at a high speed.

However, the above-described cleanerless image forming method has the following problems. In a cleanerless image forming apparatus, a cleaner blade is not provided. Thus, an external additive of toner may adhere to the photosensitive member to be recovered to the development device. The external additive recovered to the development device can be accumulated in the development device and can affect and deteriorate carrier in the development device.

In a cleanerless type full color image forming apparatus employing the above-described tandem image forming method, an external additive transferred via a transfer medium from an upstream image forming unit may be retransferred to a downstream image forming unit. Thus, the retransferred external additive may be recovered into the development device.

As a result, a larger amount of external additive may be accumulated in the development device in a downstream unit than in an upstream unit, which may cause more considerable deterioration of carrier in the development device in a downstream unit than in an upstream unit.

Once carrier deterioration occurs, toner charging performance of carrier may degrade. Thus, various phenomena, such as toner fogging, toner scattering, uneven toner, or low density, may occur.

In addition, in the case of a cleanerless image forming apparatus, a retransferred toner, which is a part of a toner image formed by an image forming unit disposed on a downstream side in the direction of conveyance of a transfer medium, can be recovered to the development device, in addition to the residual transfer toner remaining in each image forming unit.

An image forming unit disposed on a more downstream side in the direction of conveyance of a transfer medium is provided with a larger number of upstream image forming units disposed upstream thereof. Accordingly, the amount of the retransferred toner is greater in a more downstream image forming unit.

A residual transfer toner and a retransferred toner are toners that have not been transferred onto a transfer medium even when a transfer field is applied by a transfer means of an image forming unit. Accordingly, most residual transfer toners and retransferred toners have a polarity reverse to a normal polarity or have no polarity.

When the above-described residual transfer toner or retransferred toner is recovered to the development device, the charging capacity of the development device degrades. In this case, image failure may occur. An amount of retransferred toner accumulated in a development device is larger in a development device of a downstream image forming unit than that in a development device of an upstream image forming unit. Accordingly, an image failure due to accumulation of retransferred toner can more easily occur in a development device of a downstream image forming unit than in a development device of an upstream image forming unit.

In order to address this phenomenon, it is useful to raise the amount of charge of a residual transfer toner or a retransferred toner to an appropriate level using an auxiliary charging member disposed on a downstream side of a transfer means in the direction of rotation of a photosensitive member and then recover to a development device the residual transfer toner or retransferred toner having an appropriate level of amount of charge.

However, since the amount of retransferred toner is larger in a downstream image forming unit than in an upstream image forming unit, it is more likely with respect to a downstream image forming unit that the auxiliary charging member is contaminated with an accumulated toner or external additive. Accordingly, it is more difficult to control the amount of charge of a residual transfer toner or a retransferred toner with respect to a downstream image forming unit than to an upstream image forming unit.

Thus, the amount of toner in a developer in a development device, whose charge polarity is reversed against a normal polarity, can easily increase in this case. Accordingly, various phenomena, such as toner fogging, toner scattering, uneven toner, or low density, may occur.

In particular, at a time close to an end of the life of an image forming unit, in the case where the charging performance of a carrier has degraded, such phenomena can easily occur. It is very difficult to completely suppress such a retransferred toner and a retransferred external additive.

In order to address this phenomena, the life of a developer can be prolonged by using a cleanerless image forming apparatus employing an automatic developer exchanging method. However, in the case of using the automatic developer exchanging method, since a developer to be replenished includes a carrier, the following problem may arise if a ratio of carrier included in a replenishing developer is raised too high.

In this case, the cost of manufacture of a replenishing developer becomes high. Furthermore, the amount of toner to be contained in a replenishing toner bottle may decrease due to an increase in a volume of the replenishing developer by a volume equivalent to the volume of the carrier. Moreover, because of the low toner ratio in the replenishing developer, the replenishing of the developer cannot be performed at an appropriate timing in the case of forming a high density image.

SUMMARY OF THE INVENTION

The present invention is directed to an image forming apparatus configured to prevent an image failure occurring due to accumulation of a toner transferred from an upstream image forming unit.

According to an aspect of the present invention, an image forming apparatus includes a first image forming unit and a second image forming unit each including an image bearing member configured to form an electrostatic image thereon, a charging device configured to charge the image bearing member, and a development device configured to develop the electrostatic image with a developer including a mixture of toner and carrier. The apparatus also includes a transfer device configured to serially transfer toner images formed on the respective image bearing members of the first image forming unit and the second image forming unit onto a transfer medium. The second image forming unit is disposed on a downstream side of the first image forming unit in a direction of travel of the transfer medium. Each of the development devices of the first image forming unit and the second image forming unit is configured to recover a residual transfer toner remaining on each of the image bearing members. The apparatus also includes a replenishment device configured to replenish a replenishing developer including a mixture of toner and carrier to each of the development devices; and a discharge device configured to discharge the developer from each of the development devices. A weight percent of carrier in the replenishing developer to be replenished to the development device of the second image forming unit is larger than a weight percent of carrier in the replenishing developer to be replenished to the development device of the first image forming unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principle of the invention.

DETAILED DESCRIPTION OF THE EMBODIMENTS

Various exemplary embodiments, features, and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

First Exemplary Embodiment

Figure 1:
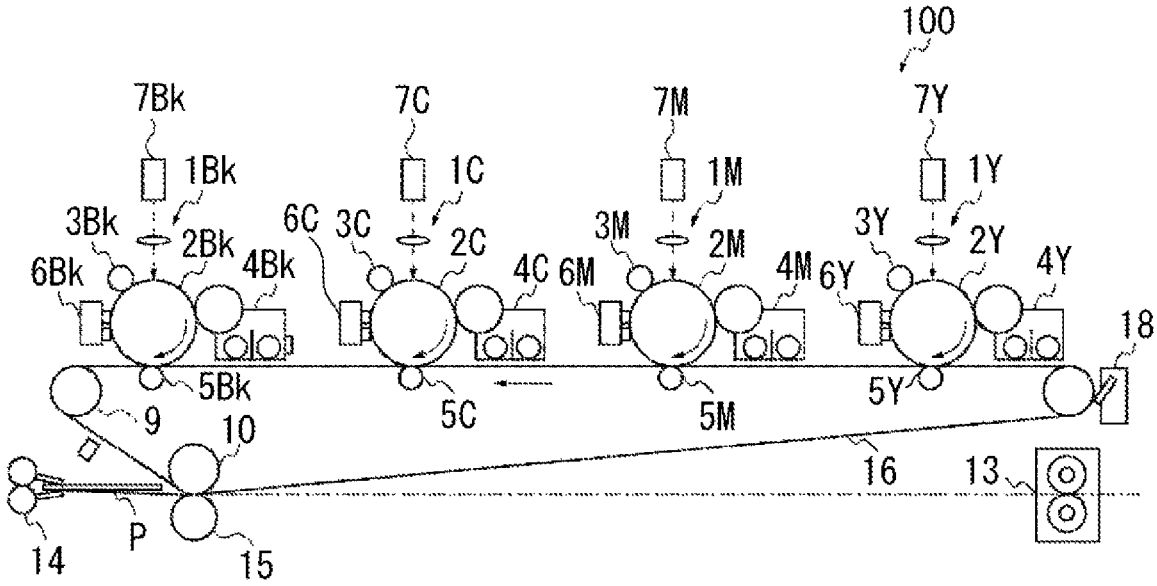
FIG. 1 illustrates an exemplary configuration of an image forming apparatus according to an exemplary embodiment of the present invention.

First, an exemplary configuration and an exemplary operation of an image forming apparatus according to a first exemplary embodiment of the present invention will be described below. FIG. 1 illustrates an exemplary configuration of an image forming apparatus 100 according to the first exemplary embodiment.

The image forming apparatus 100 is an electrophotographic full color printer having four image forming units 1Y, 1M, 1C, and 1Bk provided for four colors of yellow, magenta, cyan, and black.

The image forming apparatus 100 receives an image signal read with and sent from a document reading apparatus (not illustrated) that is connected to the image forming apparatus 100 or an image signal sent from a host apparatus, such as a personal computer, which is in communication with the image forming apparatus 100. The image forming apparatus 100 can form a full color image of four colors on a recording material, such as recording paper, a plastic film, and a cloth, according to the received image signal.

The image forming apparatus 100 transfers onto an intermediate transfer belt 16 a toner image formed by each of the image forming units 1Y, 1M, 1C, and 1Bk on each of cylinder-like electrophotographic photosensitive members (photosensitive drums) 2Y, 2M, 2C, and 2Bk, which serve as an image bearing member. Then, the image forming apparatus 100 transfers the toner image transferred on the intermediate transfer belt 16 onto a recording material P conveyed by a recording material conveyance member (not illustrated).

In the present exemplary embodiment, the four image forming units 1Y, 1M, 1C, and 1Bk of the image forming apparatus 100 have substantially the same configuration, except that the image forming units 1Y, 1M, 1C, and 1Bk develop images of different colors. Accordingly, unless it is necessary to specifically and separately refer to each of the four image forming units 1Y, 1M, 1C, and 1Bk of the image forming apparatus 100, the four image forming units 1Y, 1M, 1C, and 1Bk are hereinafter collectively referred to as an "image forming unit 1", without so much as describing the alphabets "Y", "M" "C", and "Bk" added to the reference numeral to indicate that each of them is provided corresponding to one specific color. In the same way, the photosensitive drums 2Y, 2M, 2C, and 2Bk are hereinafter collectively referred to as a "photosensitive drum 2".

The image forming unit 1 includes a cylinder-like photosensitive member, namely, the photosensitive drum 2, as an image bearing member. The photosensitive drum 2 is rotated and driven in a direction indicated with an arrow in FIG. 1.

A charge roller 3, a development device 4, a primary transfer roller 5, a secondary transfer roller 15, an opposing secondary transfer roller 10, and an auxiliary charging device 6, are disposed around the photosensitive drum 2. A laser scanner (exposure device) 7 is disposed above the photosensitive drum 2.

The intermediate transfer member (intermediate transfer belt) 16, which is a transfer medium, is disposed against the photosensitive drum 2 of the image forming unit 1. The intermediate transfer belt 16 rotates in a direction indicated with an arrow in FIG. 1 according to driving of a drive roller 9 to transfer a toner image transferred thereon to a contacting portion with a recording material P. After the toner image is transferred from the intermediate transfer belt 16 onto the recording material P, a fixing device 13 thermally fixes the toner image transferred onto the recording material P.

The image forming apparatus 100 performs the following operations, for example, in forming a full color image of four colors. First, when an image forming operation starts, a surface of the rotating photosensitive drum 2 is charged by the charge roller 3. At this time, a charge bias is applied to the charge roller 3 from a charge bias power source (not illustrated). Then, the photosensitive drum 2 is exposed with a laser beam corresponding to an image signal from the exposure device (laser scanner) 7. In this manner, an electrostatic latent image is formed on the photosensitive drum 2 according to the image signal.

The electrostatic latent image on the photosensitive drum 2 is visualized with a toner contained in the development device 4 to be a visible image. The present exemplary embodiment employs a reversing development system for adhering a toner to a portion having a light-area potential obtained by an exposure with a laser beam to decrease a charge of a surface of the image bearing member and lower the charge potential.

The image forming apparatus 100 forms a toner image on the photosensitive drum 2 with the development device 4, and primarily transfers the formed toner image onto the intermediate transfer belt 16. A toner remaining on a surface of the photosensitive drum 2 after the primary transfer (residual transfer toner) passes through the auxiliary charging device 6 and is then recovered into the development device 4. Thus, the development device 4 can recover a residual transfer toner.

A series of the above-described operations is serially performed with respect to the four colors of yellow, magenta, cyan, and black to superimpose the formed toner images of four colors on the intermediate transfer belt 16. Then, a recording material P stacked in a recording material storage cassette (not illustrated) is conveyed by a paper feed roller 14 according to a timing of forming a toner image. Then, the image forming apparatus 100 applies a secondary transfer bias to the secondary transfer roller 15 to secondarily transfer, by one operation, the toner images of four colors on the intermediate transfer belt 16 onto the conveyed recording material (transfer medium) P.

Then, the recording material P having the transferred toner images is conveyed to the fixing device 13. The fixing device 13 applies heat and pressure to the recording material P. Thus, the toner images on the recording material P are melted and mixed, and thus a full color permanent image is formed. Then, the recording material P is discharged to an outside of the image forming apparatus 100.

The image forming apparatus 100 removes a residual toner remaining on the intermediate transfer belt 16 after the transfer with an intermediate transfer belt cleaner 18. Then, a series of operations ends.

A desired single-color or multi-color image can be formed with only a desired image forming unit or units.

Figure 2:
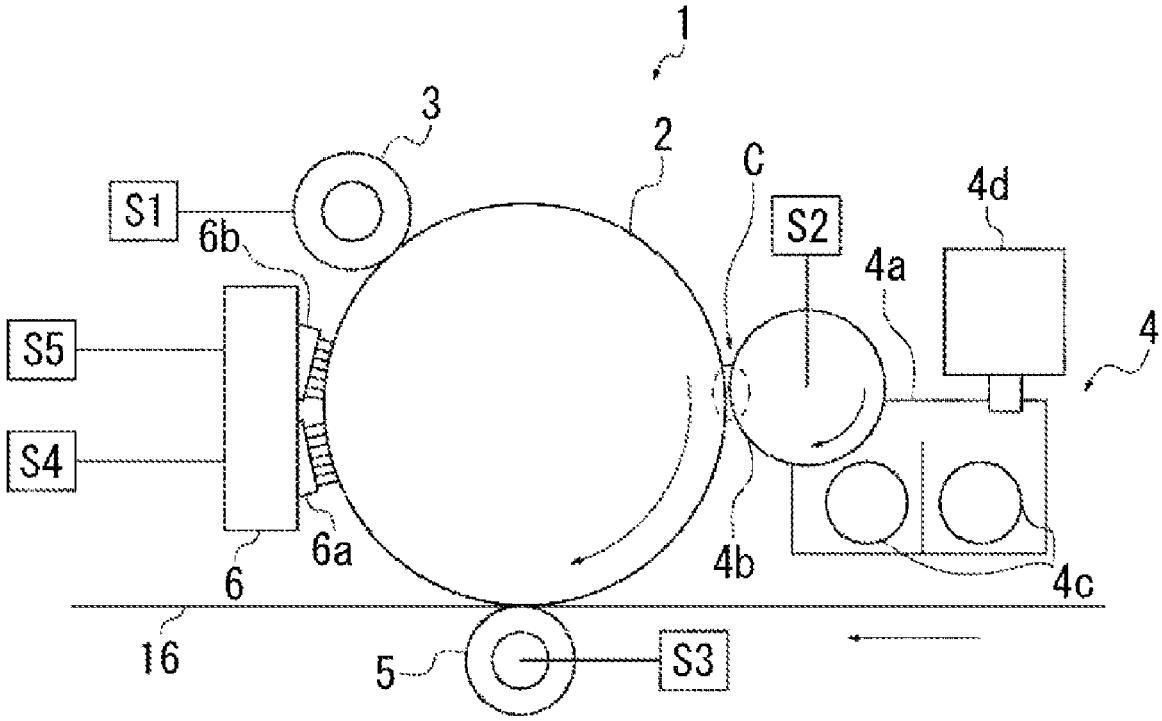
FIG. 2 illustrates an exemplary cleanerless system according to an exemplary embodiment of the present invention.

Now, an operation of the image forming unit 1 will be described in detail below with reference to FIG. 2.

In the present exemplary embodiment, the photosensitive drum 2 is an organic photoconductive member (OPC) whose charging characteristic is negative charge type. The photosensitive drum 2 has an outside diameter of about 30 mm and is driven and rotated counterclockwise as indicated with an arrow in FIG. 2 at a process speed (peripheral speed) of about 200 mm/sec around a center shaft.

The image forming apparatus 100 includes a contact charging device (the charge roller) 3 for uniformly charging a surface of the photosensitive drum 2. In the present exemplary embodiment, the contact charging device 3 is a charge roller (roller charging device) and charges the surface of the photosensitive drum 2 utilizing an electrical discharge occurring due to a minute gap between the charge roller 3 and the photosensitive drum 2.

A charge bias voltage is applied from a power source S1 to the charge roller 3. The level of the charge bias voltage is determined under a predetermined condition. Thus, the surface of the rotating photosensitive drum 2 is contact-charged to a predetermined polarity and potential. In the present exemplary embodiment, the charge bias voltage applied to the charge roller 3 is a vibrating voltage obtained by combining a DC voltage (Vdc) and an alternate current (AC) voltage (Vac).

More specifically, the charge bias voltage applied to the charge roller 3 is a vibrating voltage obtained by combining a DC voltage of −500 V and an AC voltage of a sinusoidal waveform, a frequency of 1.3 kHz, and a peak-to-peak voltage (Vpp) of 1.5 kV. With the above-described charge bias voltage, the surface of the photosensitive drum 2 can be uniformly contact-charged to −500 V (dark potential (Vd)), which level is the same as the level of the DC voltage applied to the charge roller 3.

In the present exemplary embodiment, the development device 4 employs a two-component contact development method. The two-component contact development method is a method for developing an electrostatic latent image with a magnetic brush contacting the surface of the photosensitive drum 2. The magnetic brush is made of a two-component developer, which is a mixture of toner and carrier.

The development device 4 includes a developer container 4*a* and a non-magnetic development sleeve 4*b*, which is a developer bearing member. The development sleeve 4*b* is rotatable within the developer container 4*a*, with a part of an outer peripheral surface thereof being exposed to an outside of the development device 4. A magnet roller (not illustrated), which is stationary and thus does not rotate, is inserted in the development sleeve 4*b*.

The developer container 4*a* contains a two-component developer. A developer stirring member 4*c* is disposed at the bottom of the developer container 4*a*. Furthermore, a replenishing toner is stored in a toner hopper 4*d*.

The two-component developer contained in the developer container 4*a* is primarily a mixture of non-magnetic toner and magnetic carrier. The two-component developer is stirred by the developer stirring member 4*c*. In the present exemplary embodiment, the toner includes a binding resin, a colorant, and color resin particles including other additives, as necessary.

The toner according to the present exemplary embodiment is made of a negative charge type polyester resin manufactured by polymerization. The toner can have a volume mean particle diameter of 5 μm to 8 μm. Particles such as silica and titanium oxide are externally added as an external additive to secure a sufficient level of fluidity of toner and to secure a charging characteristic of toner. In the present exemplary embodiment, the volume mean particle diameter of the toner is about 6.2 μm.

The toner is friction-charged to a negative polarity due to a sliding friction with the magnetic carrier. As the carrier, metals such as a surface iron oxide or unoxidized iron, nickel, cobalt, manganese, chromium, or a rare-earth metal, an alloy, or a ferrite (oxide) thereof, can be used. A method for manufacturing these magnetic particles is not limited to a specific method. The carrier can have a weight mean particle diameter of 20 μm to 50 μm. Particularly, the carrier can have a weight mean particle diameter of 30 μm to 40 μm. The carrier can have a magnetic reluctivity of $10^7$ Ω·cm or greater. Particularly, the carrier can have a magnetic reluctivity of $10^8$ Ω·cm or greater. In the present exemplary embodiment, the carrier of a magnetic reluctivity of $10^8$ Ω·cm is used.

In the present exemplary embodiment, as a low specific gravity magnetic carrier, a resin magnetic carrier is used which is manufactured by polymerization of a mixture of a phenolic binder resin and a magnetic metal oxide and a non-magnetic metal oxide, which are mixed at a predetermined ratio. In the present exemplary embodiment, the volume mean particle diameter of the carrier is 35 μm, a true density of the carrier is 3.6 g/cm$^3$ to 3.7 g/cm$^3$, and a magnetization quantity of the carrier is 53 A·m$^2$/kg.

The development sleeve 4*b* is disposed close to the photosensitive drum 2 in an opposing manner, with a nearest-neighbor distance (sleeve-to-drum gap (S-Dgap)) between the development sleeve 4*b* and the photosensitive drum 2 of about 350 μm. A portion of the development sleeve 4*b* opposing the photosensitive drum 2 is a development portion C.

The development sleeve 4*b* is driven and rotated in a direction opposite to the direction of rotation of the photosensitive drum 2, at the development portion C. With the magnetic force from the magnet roller inserted in the development sleeve 4*b*, a part of the two-component developer in the developer container 4*a* is attracted and held to an outer peripheral surface of the development sleeve 4*b* as a magnetic brush layer.

The magnetic brush layer is rotated and conveyed according to the rotation of the development sleeve 4*b*. The magnetic brush layer contacts the surface of the photosensitive drum 2 at the development portion C of the development sleeve 4*b* and slides on the surface of the photosensitive drum 2. A predetermined level of development bias is applied from a power source S2 to the development sleeve 4*b*.

In the present exemplary embodiment, the development bias voltage applied to the development sleeve 4*b* is a vibrating voltage obtained by combining a DC voltage (Vdc) and an AC voltage (Vac). More specifically, the development bias voltage applied to the development sleeve 4*b* is a vibrating voltage obtained by combining a DC voltage of −350 V and an AC voltage of a square waveform, a frequency of 8.0 kHz, and a peak-to-peak voltage (Vpp) of 1.8 kV.

The toner in the developer, which is coated on a surface of the rotating development sleeve 4*b* and conveyed to the development portion C, selectively adheres, according to the electrostatic latent image, to the surface of the photosensitive drum 2 due to an electric field caused by the development bias. Thus, the electrostatic latent image is developed. A thin layer of the developer on the development sleeve 4*b*, after passing through the development portion C, is returned to a developer reservoir in the developer container 4*a* according to the continuous rotation of the development sleeve 4*b*.

In the present exemplary embodiment, the image forming apparatus 100 performs the following control to keep the toner density of the two-component developer in the developer container 4*a* within a substantially constant range.

The image forming apparatus 100 detects the toner density of the two-component developer in the developer container 4*a* with an optical toner density sensor, for example. The image forming apparatus 100 controls the rotation of a toner replenishing screw propeller disposed in the toner hopper 4*d* according to a result of the detection, and replenishes the toner (replenishing developer) including a small amount of carrier into the developer container 4*a*. The toner replenished with the two-component developer is then stirred by the developer stirring member 4*c*.

The development device 4 exchanges a developer. More specifically, the development device 4 includes a developer replenishing unit and a developer discharge unit. The developer replenishing unit replenishes the replenishing developer which includes a mixture of toner and a small amount of carrier into the development device 4. The developer discharge unit discharges the developer in the development device 4 at the same time as replenishing the developer.

Figure 3:
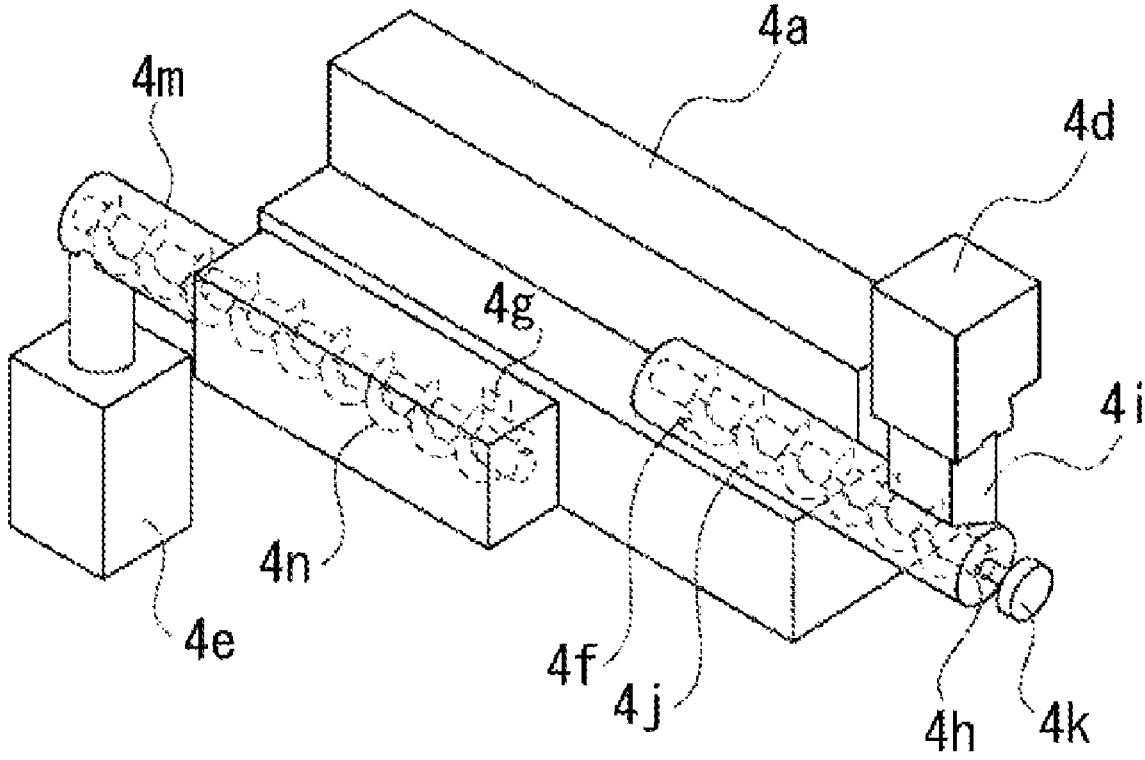
FIG. 3 illustrates a development device according to an exemplary embodiment of the present invention.

Now, the developer exchange processing by the development device 4 will be described below with reference to FIG. 3. The development device 4 replenishes and discharges the developer to automatically exchange the developer. In the present exemplary embodiment, the development device 4 replenishes the developer such that the toner density of the developer in the development device 4 becomes 7 weight percent (wt %). This specific value for the toner density can be appropriately adjusted according to the amount of charge of the toner, the particle diameter of the carrier, and the configuration of the image forming apparatus 100, and is not limited to the above-described value.

As described above, the development device 4 includes the developer container 4*a*, which develops an electrostatic latent image with the two-component developer stored and circulated therein, and a developer replenishing unit for replenishing the developer from the toner hopper (bottle) 4*d*, which contains a replenishing developer including a fresh toner and a small amount of carrier. The development device 4 further includes a discharge unit for recovering a deteriorated developer into a developer recovering tank 4*e*.

The developer container 4*a* includes a developer replenishing port 4*f* and a developer discharge port 4*g*. The developer replenishing port 4*f* includes a developer conveyance path 4*h* and a hopper 4*i*. The developer conveyance path 4*h* is used by the replenishing unit to convey the toner and the carrier contained in the toner hopper 4*d* to replenish the developer. The hopper 4*i* is used for communication between the toner hopper 4*d* and the developer conveyance path 4*h*.

A replenishment screw propeller 4*j*, which is a conveyance member, is disposed in the developer conveyance path 4*h*. The replenishment screw propeller 4*j* is rotated by a development device drive motor (not illustrated) via a clutch. At an upstream end of the replenishment screw propeller 4*j* in the direction of conveyance of the developer, an encoder 4*k* is integrally attached to the replenishment screw propeller 4*j*. The encoder 4*k* detects the rotation amount of the replenishment screw propeller 4*j*.

A discharge drain tube 4*m* is connected to the developer discharge port 4*g*. The discharge drain tube 4*m* is used for discharging a deteriorated developer. A screw propeller 4*n* is disposed in the discharge drain tube 4*m*. The screw propeller 4*n* discharges the deteriorated developer to the developer recovering tank 4*e*. The developer recovering tank 4*e* is detachably mounted.

When a fresh replenishing developer is replenished from the toner hopper 4*d* and, thus, the volume of the developer in the developer container 4*a* increases, the developer in the developer container 4*a* overflows from the developer discharge port 4*g*. Thus, the carrier is automatically exchanged.

In the developer container 4*a*, the developer replenishing port 4*f* and the developer discharge port 4*g* are disposed in the path for conveying the developer by the developer stirring screw 4*c* in the following manner. That is, the developer replenishing port 4*f*, a position at which the replenishing developer is supplied to the development sleeve 4*b*, and the developer discharge port 4*g* are disposed in this order in the developer conveyance path, from upstream to downstream, in the direction of conveyance of the developer.

In the above-described configuration with which a small amount of carrier is replenished and the developer in the development device is discharged, the deteriorated carrier in the developer container is gradually exchanged. With such a configuration, the life of the developer can be prolonged even in the case of a deterioration of the carrier, such as a phenomenon of toner spent or a contamination by an external additive.

On the other hand, if the above-described configuration or a configuration substantially similar thereto is not employed, the toner and the external additive may gradually accumulate on the surface of the carrier. Thus, the toner charging performance of the carrier is lowered. As a result, the amount of charge of toner becomes too low, causing various phenomena, such as toner fogging, toner scattering, and image degradation. The gradual exchange of the developer can reduce or suppress the degradation of carrier, and the life of the carrier can be prolonged.

In the above-described configuration, if the amount of carrier mixed in the replenishing developer contained in the toner hopper 4*d* is sufficiently large, the developer is exchanged frequently enough. Thus, the amount of average spending of the developer, which generally transits in a stabilized manner, can be made small.

Furthermore, the higher the image ratio is, the more frequent the developer is exchanged. That is, the configuration is highly useful in the case where the ratio of carrier in the replenishing developer is high and the image ratio of an output image is high.

However, since the replenishment is primarily intended to replenish the toner, the carrier ratio in the replenishing developer is up to 40 wt %, in terms of the toner replenishing amount. However, the cost of manufacture of the replenishing developer becomes higher accordingly as the ratio of carrier in the replenishing developer becomes higher.

The image forming apparatus 100 according to the present exemplary embodiment includes the intermediate transfer belt 16, as described above. Furthermore, the image forming apparatus 100 includes the primary transfer roller 5, which is a transfer roller. The primary transfer roller 5 is pressed against the photosensitive drum 2 with a predetermined level of pressure.

The primary transfer roller 5 is applied with a positive polarity transfer bias from a power source S3, which has a polarity opposite to the negative polarity that is a normal charge polarity of the toner. More specifically, in the present exemplary embodiment, the positive polarity transfer bias of +2 kV is applied. Thus, the toner images on the surface of the photosensitive drum 2 are serially electrostatically transferred onto the surface of the intermediate transfer belt 16.

The image forming apparatus 100 according to the present exemplary embodiment employs a cleanerless system. That is, the image forming apparatus 100 does not include a dedicated cleaning device for removing a residual transfer toner (residual toner) remaining on the surface of the photosensitive drum 2 in a small amount after the toner images are transferred onto the intermediate transfer belt 16.

According to the image forming apparatus 100 employing such a cleanerless system, the residual transfer toner remaining on the photosensitive drum 2 after transfer is conveyed to the development portion C via the charging portion (nip portion) and the exposure portion as the photosensitive drum 2 rotates. Then, the residual transfer toner conveyed to the development portion C is removed and recovered by the development device 4 by the development-concurrent cleaning.

In the present exemplary embodiment, the development sleeve 4*b* of the development device 4 is rotated in a direction opposite to the direction of travel of the surface of the photosensitive drum 2 at the development portion C of the development device 4, as described above. The above-described rotation of the development sleeve 4*b* is useful in recovering the residual transfer toner on the photosensitive drum 2.

The residual transfer toner on the photosensitive drum 2 passes through the exposure portion. Accordingly, the exposure processing is performed in a state where the residual transfer toner remains. In an ordinary case, the amount of the residual transfer toner is small enough, and in such a case, the exposure processing performed with the residual transfer toner remaining does not affect the image quality very much.

However, as described above, the residual transfer toner includes a toner having a normal polarity, a toner having a reversed polarity (reversed toner), and a toner having a small amount of charge, in a mixture. In this regard, the reversed toner or the toner having a small amount of charge, of a residual transfer toner, may adhere to the charge roller 3 when the residual transfer toner remaining on the photosensitive drum 2 passes through the charging portion, which may cause an excessive contamination of the charge roller 3 with the toner and may further cause a charging failure.

It is significant to keep sufficient the amount of charge of the residual transfer toner in order to effectively remove and recover the residual transfer toner on the photosensitive drum 2 with the development device 4 at the same time as the development operation. The residual transfer toner on the photosensitive drum 2, which is carried to the development portion C, should have a normal polarity and that the amount of charge of the residual transfer toner on the photosensitive drum 2 is large enough to develop the electrostatic latent image on the photosensitive drum 2.

If the polarity of the residual transfer toner is reversed or if the amount of charge of the residual transfer toner is too low, the residual transfer toner cannot be properly removed from the photosensitive drum 2 or recovered to the development device 4. This may cause an image failure. In order to prevent this, the image forming apparatus 100 includes the following two auxiliary charging units.

The image forming apparatus 100 includes a residual toner formalizing unit (residual developer image formalizing unit) 6*a*. The residual toner formalizing unit 6*a* is disposed at a position downstream of the transfer portion in the direction of rotation of the photosensitive drum 2. The residual toner formalizing unit 6*a* formalizes the residual transfer toner on the photosensitive drum 2.

In addition, the image forming apparatus 100 includes a toner charge amount control unit (developer charge amount control unit) 6*b*. The toner charge amount control unit 6*b* is disposed at a position downstream of the residual toner formalizing unit 6*a* in the direction of rotation of the photosensitive drum 2 and downstream of the charging portion in the direction of rotation of the photosensitive drum 2. The toner charge amount control unit 6*b* controls the charge polarity of the residual transfer toner to a negative polarity, which is a normal polarity.

Generally, a reverse toner and a toner having a low amount of charge are mixed in the residual transfer toner remaining on the photosensitive drum 2 after transfer. The residual toner formalizing unit 6*a* eliminates the charge of the residual transfer toner, and then the toner charge amount control unit 6*b* charges the diselectrified residual transfer toner to a normal charge.

Accordingly, the adhesion of the residual transfer toner to the charge roller 3 can be effectively prevented. Furthermore, the residual transfer toner can be completely removed and recovered by the development device 4. Thus, a ghost image occurring due to the residual transfer toner image pattern can be suppressed.

The residual toner formalizing unit 6*a* and the toner charge amount control unit 6*b* according to the present exemplary embodiment are brush-like members having an appropriate level of conductivity. The residual toner formalizing unit 6*a* and the toner charge amount control unit 6*b* are disposed with the brush portion contacting the surface of the photosensitive drum 2. The brush portion of the residual toner formalizing unit 6*a* forms a contact portion with the surface of the photosensitive drum 2. The brush portion of the toner charge amount control unit 6*b* also forms a contact portion with the surface of the photosensitive drum 2.

The residual toner formalizing unit 6*a* is applied with a DC current of a positive polarity from a power source S4. The toner charge amount control unit 6*b* is applied with a DC current of a negative polarity from a power source S5.

Figure 4A:
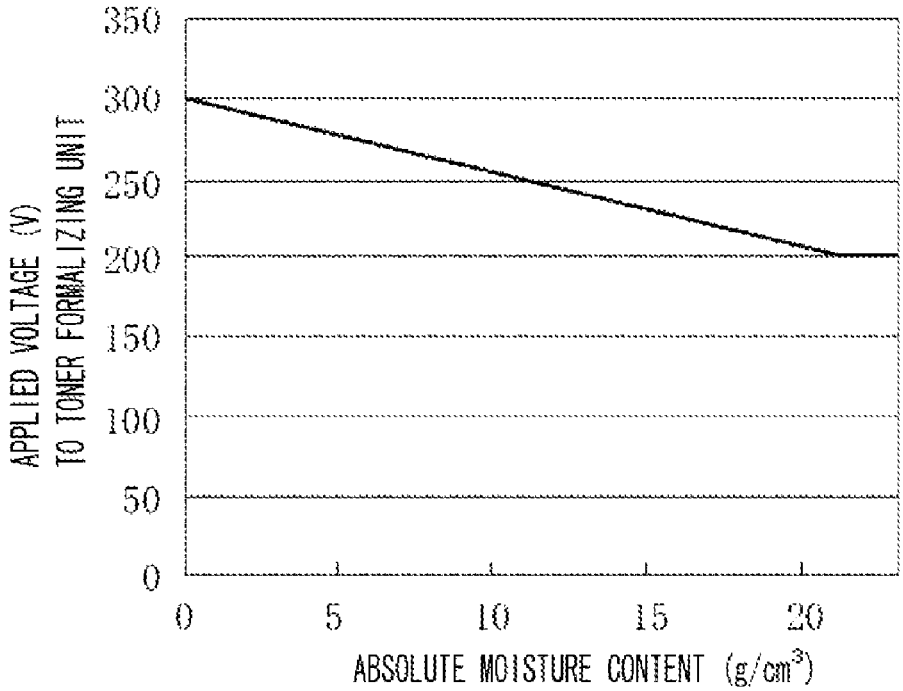
FIG. 4A illustrates a relationship between an applied voltage and an absolute moisture content in a residual toner formalizing unit according to an exemplary embodiment of the present invention.
Figure 4B:
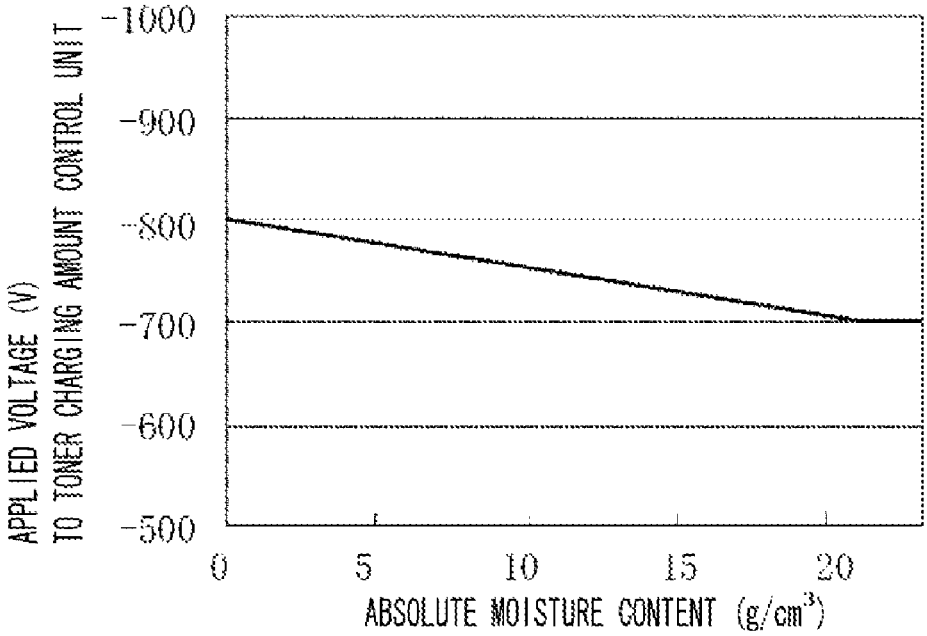
FIG. 4B illustrates a relationship between an applied voltage and an absolute moisture content in a toner charge amount control unit according to an exemplary embodiment of the present invention.

The level of the DC current applied to each of the residual toner formalizing unit 6*a* and the toner charge amount control unit 6*b* is changed, as illustrated in FIGS. 4A and 4B, according to an absolute moisture content. The absolute moisture content is calculated based on the temperature and a relative humidity detected by a temperature and humidity sensor installed in the image forming apparatus 100. For example, under an environment in which the temperature is 23° C. and the absolute moisture content is 10.5 g/m$^3$, the DC voltage of +250 V is applied to the residual toner formalizing unit 6*a* and the DC voltage of −750 V is applied to the toner charge amount control unit 6*b*.

When the residual transfer toner, which remains on the photosensitive drum 2 at the transfer portion after transferring the toner image onto the intermediate transfer belt 16, reaches the contact portion between the residual toner formalizing unit 6*a* and the photosensitive drum 2, the amount of charge of the residual transfer toner is formalized by the residual toner formalizing unit 6*a* to around 0 μC/g.

Then, the residual transfer toner on the surface of the photosensitive drum 2, which has been formalized by the residual toner formalizing unit 6*a*, reaches the contact portion between the toner charge amount control unit 6*b* and the photosensitive drum 2. At this time, the toner charge amount control unit 6*b* controls the polarity of the toner to a negative polarity, which is a normal polarity.

By controlling the polarity of the residual transfer toner to a negative polarity, a mirroring property of the residual transfer toner to the photosensitive drum 2 at the contact portion (charging portion) between the charge roller 3 and the photosensitive drum 2 is made high. Thus, the adhesion of the residual transfer toner to the charge roller 3 can be prevented or reduced. The amount of charge provided by the toner charge amount control unit 6*b* to the residual transfer toner can be approximately twice as large as the amount of charge of toner at the time of development. That is, under an environment in which the temperature is 23° C. and the absolute moisture content is 10.5 g/m$^3$, the amount of charge provided by the toner charge amount control unit 6*b* to the residual transfer toner is approximately −50 μC/g.

The auxiliary charging device 6 is installed with a reciprocation mechanism (not illustrated). The driving of the photosensitive drum 2 and the reciprocation mechanism is performed by the same drive source. With the reciprocation mechanism, an auxiliary charging member is reciprocated in a main scanning direction. Thus, the residual transfer toner on the photosensitive drum 2 and an abrasive particle (to be described later below) can be effectively collected in the residual toner formalizing unit 6*a* or the toner charge amount control unit 6*b*.

Now, the recovery of the residual transfer toner performed during the development processing will be described below.

As described above, the development device 4 recovers and cleans the residual transfer toner at the same time as the development processing. Under an environment in which the temperature is 23° C. and the absolute moisture content is 10.5 g/m$^3$, the amount of charge of toner (average value) used in developing an electrostatic latent image on the photosensitive drum 2 is approximately −25 μC/g. The amount of charge of the residual transfer toner reaching the development device 4 can be in the range of approximately 15 μC/g to 35 μC/g in order to effectively recover the residual transfer toner on the photosensitive drum 2 to the development device 4.

However, in order to recover, to the development device 4, the residual transfer toner charged in a large amount by the toner charge amount control unit 6*b* to the negative polarity of −50 μC/g to prevent the adhesion of toner to the charge roller 3, it is necessary to eliminate the charge of the residual transfer toner.

Here, an AC voltage (frequency=1.3 kHz, peak-to-peak voltage Vpp=1.5 kV) is applied to the charge roller 3 to charge the surface of the photosensitive drum 2. At the same time as the charge roller 3 charges the surface of the photosensitive drum 2, the residual transfer toner on the photosensitive drum 2 is AC-diselectrified. Under such AC voltage condition, the amount of charge of the residual transfer toner of about −50 μC/g is increased to about −30 μC/g after passing through the charging portion.

Accordingly, during the development processing, the residual transfer toner on the photosensitive drum 2 adhering to a portion of the photosensitive drum 2 in which the toner should not adhere to (dark potential (Vd)) is recovered to the development device 4 due to the potential difference between potentials Vdc and Vd.

By the following operations (i) and (ii), the development device 4 can effectively recover the residual transfer toner:

(i) The toner charge amount control unit 6*b* controls the amount of charge of the residual transfer toner, which is conveyed from the transfer portion to the charging portion as the photosensitive drum 2 rotates, to the negative polarity (normal polarity) and charges the residual transfer toner, in order to prevent the adhesion of the residual transfer toner to the charge roller 3.

(ii) The charge roller 3 controls the amount of charge of the residual transfer toner, which has been charged to the negative polarity by the toner charge amount control unit 6*b*, to substantially the same amount of charge for developing the electrostatic latent image on the photosensitive drum 2 with the development device 4, at the same time as the charge roller 3 charges the photosensitive drum 2 to a predetermined potential.

According to the cleanerless system, in particular, according to the development-concurrent cleaning system, it is not necessary to provide the image forming apparatus 100 with a conventional cleaning device. Furthermore, the deteriorated toner can be recycled without leaving a waste toner. Accordingly, the operator's trouble of frequently performing maintenance operations can be saved and an image forming apparatus can be easily downsized. In addition, the above-described configuration is useful in terms of environmental protection and effective utilization of resources.

Now, a retransferred toner and a retransferred external additive will be described below.

A primary residual transfer toner, which has been formed by each of the image forming units 1, is conveyed to the second, the third, and the fourth image forming units 1M, 1C, and 1Bk, and in addition, a retransferred toner and a retransferred external additive, which are a part of the toner image formed by an upstream image forming unit in the direction of travel of the intermediate transfer belt (intermediate transfer medium) 16, are conveyed to the second, the third, and the fourth image forming units 1M, 1C, and 1Bk.

A "retransfer" is such a phenomenon that a part of the toner image which has been transferred onto the intermediate transfer belt 16 by the upstream image forming unit 1 in the direction of travel of the intermediate transfer belt 16, when passing through the primary transfer portion of the downstream image forming unit 1, adheres to the surface of the photosensitive drum 2 of the downstream image forming unit 1. The external additive only or both the external additive and the toner are retransferred onto the downstream photosensitive drum 2.

The retransferred toner and the retransferred external additive adhere to the photosensitive drum 2 due to the transfer electrical field generated in the primary transfer portion and the mirroring property of retransferred toner to the photosensitive drum 2. An image forming unit disposed on a downstream side is provided with a larger number of upstream image forming units. Accordingly, the amount of the retransferred toner and the amount of the retransferred external additive are greater in a downstream image forming unit than in an upstream image forming unit.

That is, typically, the amount of retransferred toner, with respect to the first, the second, the third, and the fourth image forming units 1Y, 1M, 1C, and 1Bk, can be expressed as "1Y<1M<1C<1Bk". As can be known from this expression, the amount of contaminating external additive is greater in a downstream image forming unit. Accordingly, the contamination of the carrier with the retransferred external additive is more considerable in a downstream image forming unit than in an upstream image forming unit.

As described above, the residual primary transfer toner and the retransferred toner are toners that have not been transferred onto the intermediate transfer belt 16 when the transfer electrical field is applied in the primary transfer portion of the image forming unit 1. Accordingly, most of the residual transfer toners and the retransferred toners have a polarity opposite to the normal polarity, or do not even have a polarity.

Furthermore, with respect to the toner shape, most of the residual transfer toners and the retransferred toners are deformed toners or have a particle diameter different from a mean particle diameter. Moreover, since the retransferred toner is a part of the toner image formed with a different color toner formed by an upstream image forming unit 1, the retransferred toner may have a different toner characteristic.

As described above, the residual toner formalizing unit 6*a*, the toner charge amount control unit 6*b*, and the charge roller 3, which are disposed on a downstream side of the primary transfer portion in the direction of rotation of the photosensitive drum 2, control the amount of charge of the residual primary transfer toner and the retransferred toner to an appropriate level, and the development device 4 recovers the residual primary transfer toner and the retransferred toner having the appropriate level of amount of charge.

However, since a downstream image forming unit 1 may receive a greater amount of retransferred toner, the residual toner formalizing unit 6*a* and the toner charge amount control unit 6*b* are liable to be contaminated with the accumulated toner and external additive. Thus, the control of the amount of charge of the residual transfer toner and the retransferred toner may be less appropriately performed in a downstream image forming unit 1 than in an upstream image forming unit 1.

Figure 5:
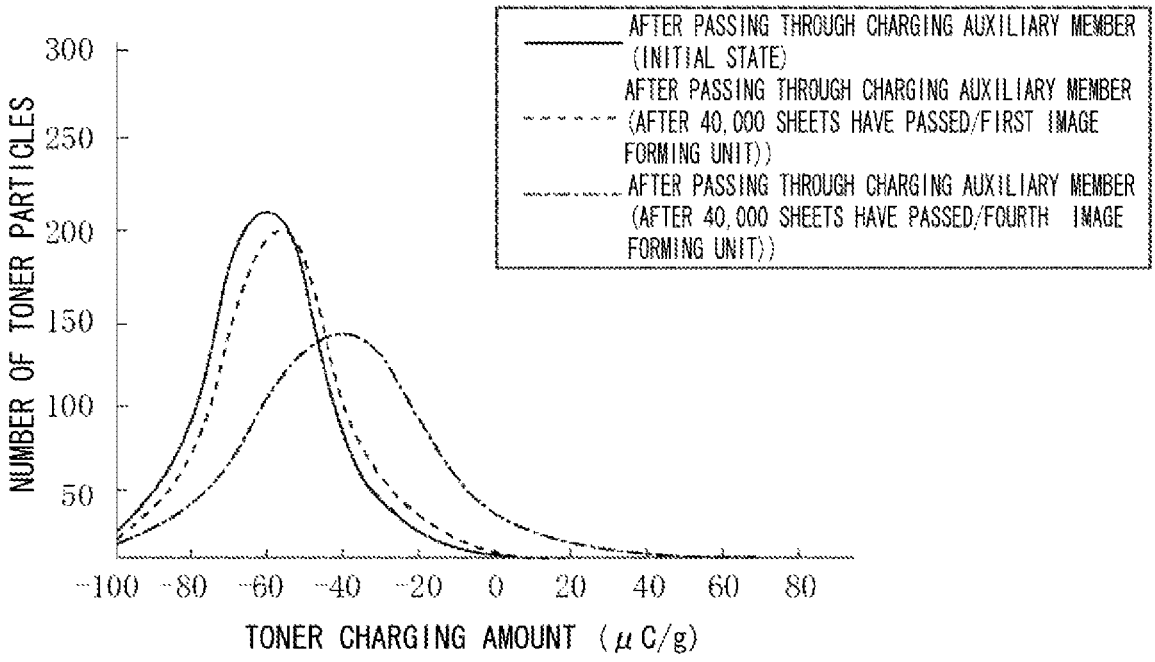
FIG. 5 illustrates a distribution of an amount of charge of toner after the toner has passed through an auxiliary charging member according to an exemplary embodiment of the present invention.

FIG. 5 illustrates a distribution of the amount of charge of the residual primary transfer toner after passing through the residual toner formalizing unit 6*a* and the toner charge amount control unit 6*b*. In FIG. 5, a full line indicates a distribution of the amount of charge in a state where only a small number of images have been output and the residual toner formalizing unit 6*a* and the toner charge amount control unit 6*b* are not so considerably contaminated. A broken line in FIG. 5 indicates a distribution of the amount of charge of the residual transfer toner in the first image forming unit 1Y in the case where forty thousand color images have been output and a solid image (an image that has a highest possible density) was output subsequently thereto. The forty thousand color images have an average image ratio of 15% with respect to each color of yellow, magenta, cyan, and black.

An alternate long and short dash line in FIG. 5 indicates a distribution of the amount of charge of the residual transfer toner in the fourth image forming unit 1Bk in the case where forty thousand color images have been output and a solid image (an image that has a highest possible density) was output subsequently thereto. The forty thousand color images have an average image ratio of 15% with respect to each color of yellow, magenta, cyan, and black.

In the fourth image forming unit 1Bk, after a large number of images have been formed, the toner charge amount adjustment performance of the residual toner formalizing unit 6*a* and the toner charge amount control unit 6*b* degrades. The same applies to the second and the third image forming units 1M and 1C.

Furthermore, typically, the degree of degradation of the toner charge amount adjustment performance of the residual toner formalizing unit 6*a* and the toner charge amount control unit 6*b* is greater in a downstream image forming unit in the direction of travel of the intermediate transfer belt 16.

As a result, most of the toners that have passed through the residual toner formalizing unit 6*a* and the toner charge amount control unit 6*b* may have a positive polarity instead of a normal negative polarity or have no polarity (amount of charge≈0 μC/g).

The positive polarity toner and the toner with no polarity and having the amount of charge about 0 μC/g are not recovered by the development device 4 in an electrical field with a fog removing potential (Vback: potential difference between Vd and Vdc) in the development portion C.

According to the present exemplary embodiment, in a case where the development device 4 employs the above-described two-component contact development method, the toner on the photosensitive drum 2 can be properly removed from the photosensitive drum 2 by the magnetic brush on the development sleeve 4*b* to be effectively recovered into the development device 4.

Thus, the amount of charge of the toner in the development device 4 is widely distributed and the average amount of charge degrades. As a result, the toner may adhere to a white portion (non-image portion) of the surface of the photosensitive drum 2 that generates a fog removing potential (Vback) in a portion between the photosensitive drum 2 and the development sleeve 4*b*. Thus, an image failure, such as fogging, is liable to occur.

That is, in the latter half of the life of the image forming unit 1 and thus the carrier has been degraded, the amount of charge of the toner recovered to the development device 4 cannot be controlled to an appropriate level. Thus, it is necessary to more effectively suppress the degradation of carrier occurring in a downstream image forming unit than in an upstream image forming unit.

Figure 6:
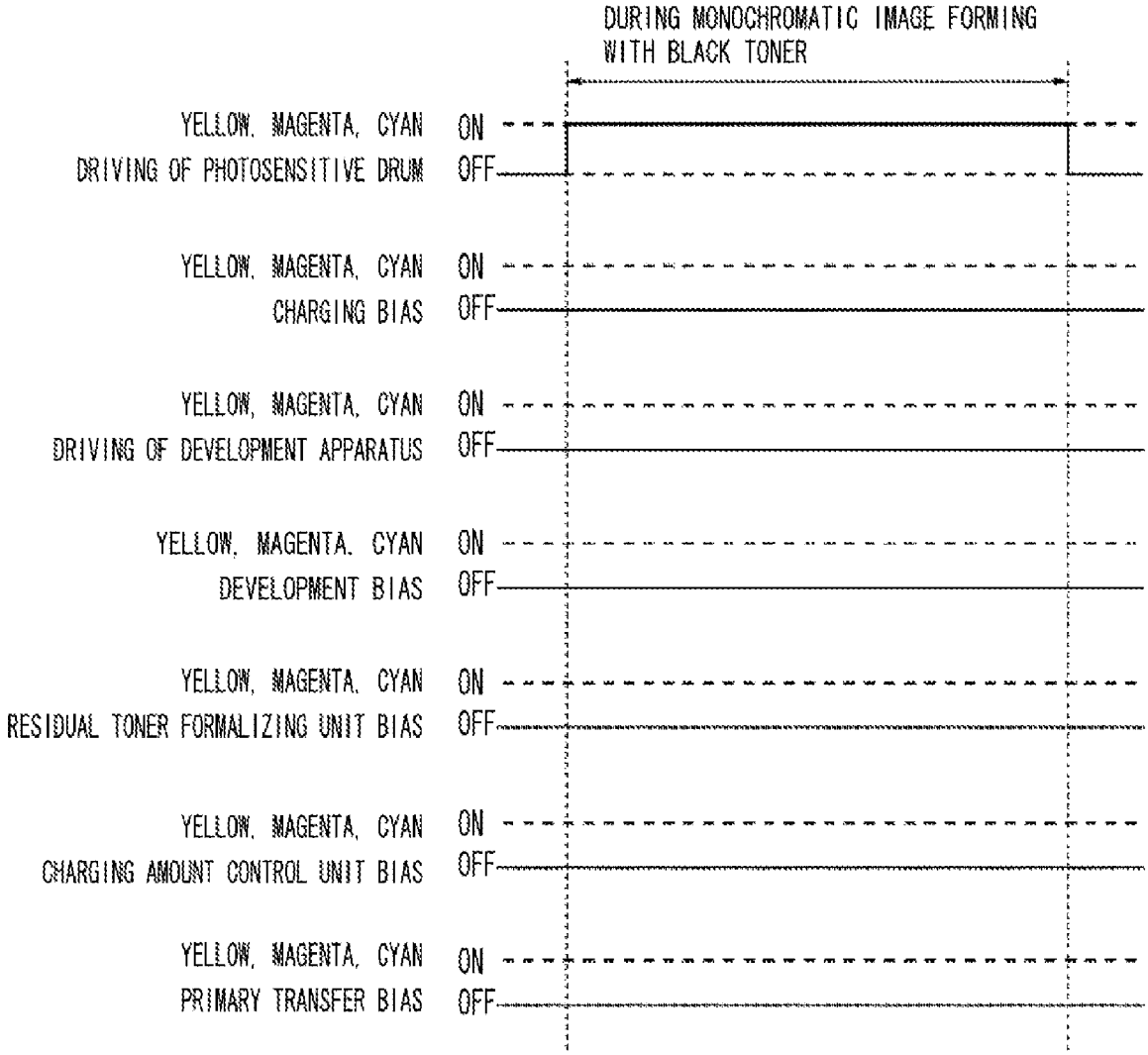
FIG. 6 illustrates an exemplary operation of image forming units for yellow, magenta, and cyan performed during an operation for forming an image of a single color of black according to a first exemplary embodiment and a second exemplary embodiment of the present invention.

FIG. 6 is a timing chart for each of the four colors of yellow, magenta, and cyan, in the case of forming an image with a single color of black (monochromatic image) according to the present exemplary embodiment. When the image forming unit 1 forms a monochromatic image, the photosensitive drum 2 of each image forming unit 1 for yellow, magenta, and cyan, which does not perform an image forming operation, is idle-rotated.

Now, a developer that is useful in the present exemplary embodiment will be described below.

In the present exemplary embodiment, a developer that is a mixture of magnetic carrier (to be described later below) and non-magnetic toner including a pigment for each color is used. The magnetic carrier and the non-magnetic toner are mixed such that the density of the toner included in the developer becomes 7 wt % in an initial state. The weight percent of carrier in the developer contained in the development device 4 is about 93 wt %.

As the magnetic carrier contained in the developer, metals such as a surface iron oxide or unoxidized iron, nickel, cobalt, manganese, chromium, or a rare-earth metal, an alloy, a ferrite thereof, or a ferrite made of oxides thereof, can be used. A method for manufacturing these magnetic particles is not limited to a specific method. The magnetic carrier can be coated with a resin by a known method.

In the present exemplary embodiment, ferrite particles including a neodymium, a samarium, and a barium are coated with resin. The weight mean particle diameter of the magnetic carrier is 20 μm to 100 μm. Particularly, the weight mean particle diameter can be 20 μm to 70 μm. As the carrier for the color developer, a magnetic carrier having a volume resistance value (specific resistance) of $10^7$ Ω·cm to $10^9$ Ω·cm is used. As the carrier for the black developer, a magnetic carrier having a volume resistance value of $10^9$ Ω·cm to $10^{10}$ Ω·cm is used.

The specific resistance of the magnetic carrier is measured by detecting the level of the current flowing in the case where the magnetic carrier is filled in a cell, one pair of electrodes is provided so that the electrodes contact the filled carrier, and a voltage is applied between the electrodes. The measurement conditions for the specific resistance are such that a contacting area of the filled carrier and the electrodes are about 2.3 $cm^2$, the depth of the filled carrier is about 2 mm, the load of the upper electrode is 180 g, and the applied voltage is 100 V.

In this case, since the magnetic carrier is particles, the filling ratio may vary, and thus the specific resistance may vary according thereto. Therefore, filling of the carrier should be deliberately performed.

If the resistance of the carrier becomes lower than $1.0\times10^7$ Ω·cm, the carrier resistance is so low that the carrier is easy to be overcharged, resulting in excessive adhesion of carrier. Accordingly, this value is the lower limit for the resistance of the carrier. On the other hand, if the resistance of the carrier becomes $1.0\times10^{10}$ Ω·cm or higher, the carrier resistance is so high that the toner is affected from the surrounding developer and thus bears a substantially insulative electrical characteristic, resulting in easily causing a phenomenon, such as a development failure or excessive edge enhancement. Accordingly, this value or a value therearound is the upper limit for the resistance of the carrier.

A mean particle diameter of the magnetic carrier is indicated by a maximum length in the vertical direction. In the present exemplary embodiment, the mean particle diameter of the magnetic carrier is calculated in the following manner. That is, first, the carrier is photographed with a microscope at a magnification ratio of 50 times to 1,000 times. Then, 3,000 or more carrier particles are selected at random from the carrier particles taken in the obtained microscopic photograph. Then, a longer axis of each of the selected particles is actually measured to calculate an arithmetic mean value.

With respect to a magnetization quantity of the carrier, carriers having a magnetization quantity of about $3.0\times10^5$ A/m, which is a magnetic property of a typical ferrite, are used.

However, the value for the magnetic property is not limited to this. That is, the carriers can have a magnetic property ranging from $3.0\times10^4$ A/m to $3.0\times10^5$ A/m.

In this regard, if carriers having a magnetic property lower than $3.0\times10^4$ A/m are used, a phenomenon such as a coating failure of the developer on a development sleeve may occur. On the other hand, if carriers having a magnetic property higher than $3.0\times10^5$ A/m are used, a granularity of an image may become too high due to an uneven magnetic brush. In this regard, the present exemplary embodiment uses the carriers having a magnetic property ranging from $3.0\times10^4$ A/m to $3.0\times10^5$ A/m.

The magnetization quantity is calculated with a vibrating magnetic field type magnetic property automatic recording apparatus of Riken Denshi Co., Ltd., by first calculating a magnetization intensity ($Am^2/kg$) of carriers packed in an external magnetic field of 100 mT, and then multiplying the resulting magnetization intensity by an absolute specific gravity ($kg/cm^3$) of the carrier.

In the present exemplary embodiment, a conventional pulverized toner can be used for the toner contained in the developer being mixed with the above-described magnetic carrier. A toner can have a volume mean particle diameter of 4 μm to 15 μm.

Furthermore, in the present exemplary embodiment, an external additive having a weight mean particle diameter smaller than 1/10 of the weight mean particle diameter of the toner, in terms of durability of the external additive when mixed with the toner, can be used. The particle diameter of the external additive refers to a mean particle diameter obtained by observing the surface of the toner particles using a microscope. An external additive of 0.01 to 80 parts by weight to toner particles of 100 parts by weight is used. An external additive of 0.05 to 60 parts by weight to toner particles of 100 parts by weight can be used.

As the external additive, the following can be used:

a metal oxide, such as an aluminum oxide, a titanium oxide, a strontium titanate, a ceric oxide, a magnesium oxide, a chromium oxide, a tin oxide, and a zinc oxide;

a nitride, such as a silicon nitride;

a carbide, such as a silicon carbide;

a metallic salt, such as, a calcium sulfite, a barium sulfate, and a calcium carbonate;

a fatty acid metallic salt, such as a zinc stearate and a calcium stearate;

a carbon black; and a silica.

One external additive or a combination of any of the above-described external additives can be used. A hydrophobic external additive(s) can be used. However, the external additive serves to provide fluidity to the toner and control the amount of charge of the toner. Accordingly, the polarity of the external additive is significant.

In the present exemplary embodiment, a silica of a negative polarity is externally added at 3.0 wt % and a titanium oxide having a weak positive polarity is externally added at 1.0 wt % to the toner having a negative polarity. Both the silica and the titanium oxide serve to improve the toner fluidity. The silica also serves to increase the amount of charge of toner.

The toner containing that above-described components can have a negative polarity or a positive polarity. In the present exemplary embodiment, a toner having a negative charge polarity and whose average amount of charge of toner (charge generated by friction against the carrier) (amount of charge per unit weight (Q/M)) ranging from $-1.0\times10^{-2}$ C/kg to $-6.0\times10^{-2}$ C/kg is used.

Now, the photosensitive drum 2 according to the present exemplary embodiment will be described below.

Figure 7:
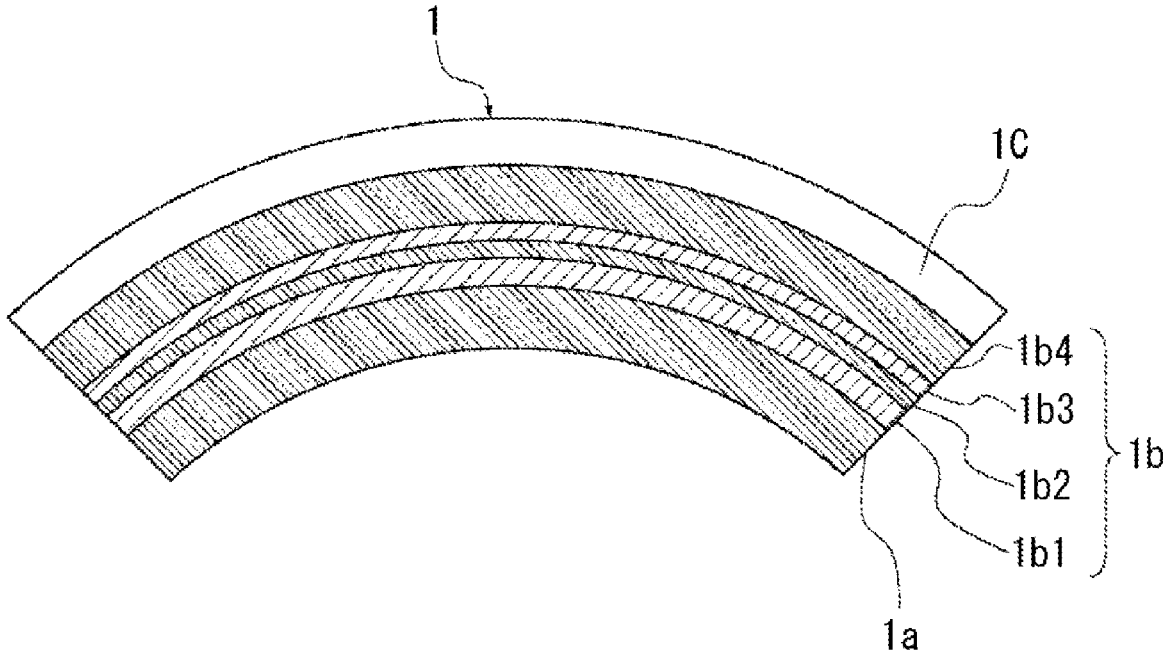
FIG. 7 illustrates an exemplary configuration of an organic photosensitive drum according to an exemplary embodiment of the present invention.

In the present exemplary embodiment, an organic photoconductive drum having a diameter of about 30 mm is used as the photosensitive drum 2. As illustrated in FIG. 7, the photosensitive drum 2 includes a drum base member 1*a*, a photosensitive member layer 1*b*, and a protection layer (outer cover layer (OCL)) 1*c*. The drum base member 1*a* is earthed and made of a conductive material, such as aluminum. The photosensitive member layer 1*b* is made of a typical organic photoconductive member layer (OPC). The protection layer 1*c*, which is highly friction-resistant, is coated and formed on the photosensitive member layer 1*b*.

The photosensitive member layer 1*b* includes four layers, namely, a subbing layer (CPL) 1*b*1, an injection prevention layer (UCL) 1*b*2, a charge generation layer (CGL) 1*b*3, and a charge transportation layer (CTL) 1*b*4. The photosensitive member layer 1*b* is typically an insulative member. It is a characteristic of the photosensitive member layer 1*b* to become a conductive member after being irradiated with light of a specific frequency. This is caused because when the light is irradiated onto the photosensitive member layer 1*b*, a hole (an electron pair) is generated in the charge generation layer 1*b*3, which serves to flow the charge.

The charge generation layer 1*b*3 is made of a phthalocyanine compound having a thickness of about 0.2 μm. The charge transportation layer 1*b*4 is made of polycarbonate prepared by scattering a hydrazone compound having a thickness of about 25 μm. The life of the organic photosensitive drum used in the present exemplary embodiment is 10,000 sheets.

Figure 8:
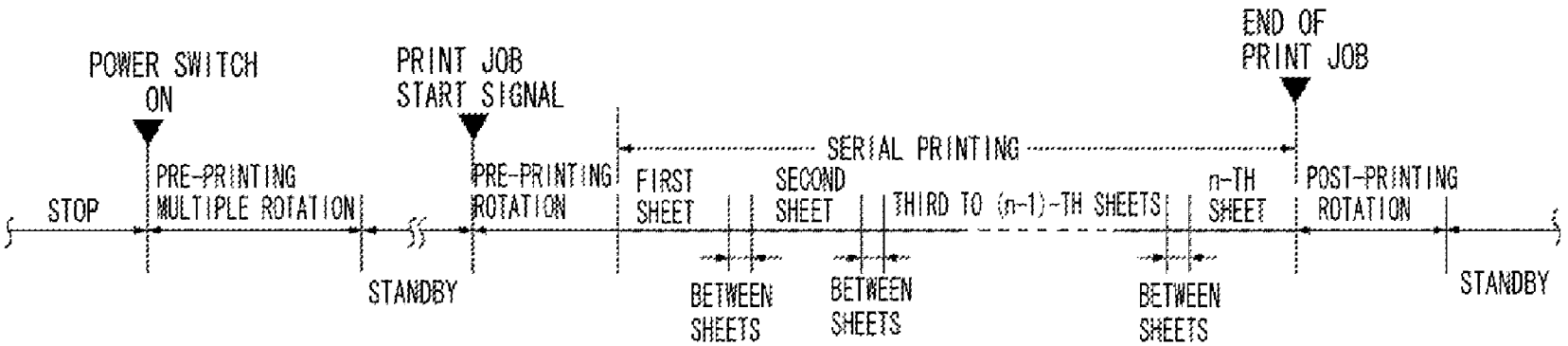
FIG. 8 illustrates operations performed by the image forming apparatus according to an exemplary embodiment of the present invention.

FIG. 8 illustrates a series of operations performed by the image forming apparatus 100 according to the present exemplary embodiment. The image forming apparatus 100 according to the present exemplary embodiment performs the following operations a to g.

a: Pre-printing multiple rotation

The pre-printing multiple rotation is a processing operation for starting up (warming up) the image forming apparatus 100. When a main power switch of the image forming apparatus 100 is pressed (when the image forming apparatus 100 is powered on) by a user, the image forming apparatus 100 activates a main motor and performs a preparation operation for concerned processing units.

b: Standby

After the predetermined warm-up operations are completed, the image forming apparatus 100 stops the driving of the main motor, and the image forming apparatus 100 waits until a print job start signal is input by the user in a standby state.

c: Pre-printing rotation

When a print job start signal is input, the image forming apparatus 100 resumes driving of the main motor and performs a pre-printing operation of the concerned processing units.

In an actual operation of the image forming apparatus 100, the image forming apparatus 100 performs the operations in the following order:

1. The image forming apparatus 100 receives a print job start signal.

2. A formatter rasterizes a read image. The time taken for rasterization varies according to the data amount of the read image and the processing speed of the formatter.

3. The image forming apparatus 100 starts the pre-printing rotation. If a print job start signal has already been received during the pre-printing multiple rotation in the above-described operation "a", the image forming apparatus 100 shifts to the pre-printing rotation without performing the standby operation in the above-described operation "2" after the pre-printing multiple rotation is completed.

d: Start print job

After the predetermined pre-printing rotation is completed, the image forming apparatus 100 performs the above-described image forming operation and outputs a recording material having a formed image. In the case of a serial print job, the image forming apparatus 100 repeats the image forming operation and serially outputs a predetermined number of recording materials having a formed image.

e: Between-sheet operation

In the case of a serial print job, the image forming apparatus 100 performs a between-sheet operation on a portion between a trailing edge of a preceding recording paper P and a leading edge of a subsequent recording material P. No recording paper P passes through the transfer means or the fixing device during the between-sheet operation.

f: Post-printing rotation

In the case of a print job for one sheet only, the image forming apparatus 100 continues driving the main motor for a predetermined length of time after a recording material P having a formed image is output. In the case of a serial print job, the image forming apparatus 100 continues driving the main motor for a predetermined length of time after a last recording material P having a formed image in the serial print job, of a plurality of recording materials P, is output. Thus, the image forming apparatus 100 performs a post-printing operation of the concerned processing units.

g: Standby

After the predetermined post-printing rotation is completed, the image forming apparatus 100 stops driving the main motor, and waits until a next print job start signal is input by the user in a standby state.

Among the above-described operations, the operation for performing a print job in the above-described operation "d" is an "image forming period". The pre-printing multiple rotation, the pre-printing rotation, the between-sheet operation, and the post-printing rotation in the above-described operations "a", "c", "e", and "f" are "non-image forming periods".

More specifically, the "non-image forming period" refers to a time period for at least one operation among the above-described pre-printing multiple rotation, pre-printing rotation, between-sheet operation, and post-printing rotation operations. Furthermore, the "non-image forming period" refers to at least a predetermined partial length of time within one of the above-described pre-printing multiple rotation, pre-printing rotation, between-sheet operation, and post-printing rotation operations.

Experimental Example 1

Now, a problem that has occurred in the image forming apparatus 100 having the above-described configuration will be described. In the present exemplary embodiment, in the case where the ratio of carrier in the replenishing developer for each color of yellow, magenta, cyan, and black is 10%, the following problems arose. Note here that the ratio of carrier in the replenishing developer refers to a weight percent of the carrier to the weight of the replenishing developer.

When a full color image having an image ratio of 10% was formed, phenomena, such as toner fogging, toner scattering, and an increase in toner granularity (uneven toner), occurred with respect to the colors of magenta, cyan, and black. These phenomena occurred more considerably in a downstream image forming unit than in an upstream image forming unit.

Table 1 illustrates a detailed result with respect to the toner fogging, toner scattering, toner granularity, and toner charge amount degradation in the case where six hundred thousand full color images had been printed.

With respect to the toner fogging, a result of measuring a reflection ratio of fogging on the sheet in the case of conveying a solid white image is described in Table 1. With respect to the toner scattering, a result of measuring a degree of contamination on a laser scanner window is described in Table 1, by a three-stage evaluation. In Table 1, "o" indicates that substantially no toner was scattered (that the result was good), "Δ" indicates that only a small amount of toner scattering not affecting the image quality occurred, and "x" indicates that a large amount of toner scattering affecting the image quality occurred (no good (NG)).

The granularity (uneven toner) was measured by a visual inspection. In Table 1, "o" indicates that the degree of granularity was sufficient (that the result was good), "Δ" indicates that the granularity of the toner increased from an initial (fresh) state but did not affect the image quality, and "x" indicates that the granularity of a level affecting the image quality occurred (no good (NG)). The acceptance line of the toner fogging was set to less than 2.0%. With respect to the toner scattering and the granularity level, the acceptance line was set to "Δ" or higher. The toner charge amount degradation ratio (%) was measured at an initial state and at a state after passing six hundred thousand sheets, by a two-component blow-off method. The toner charge amount degradation ratio was calculated by calculating a degradation ratio of the amount of charge of toner after passing the sheets to the initial amount of charge of toner.

TABLE 1

| | Image forming unit | | | |
|---|---|---|---|---|
| | Y | M | C | Bk |
| Fogging reflection ratio | 1.7% (OK) | 2.1% (NG) | 2.1% (NG) | 3.5% (NG) |
| Scattering level | ○ | Δ | x | x |
| Granularity | ○ | Δ | x | x |
| Amount of charge of toner variation ratio (—) | 7% | 12% | 20% | 30% |

As described in Table 1, in the experimental example 1, the toner fogging, the toner scattering, and the toner granularity level (uneven toner) occurred more considerably in a downstream image forming unit than in an upstream image forming unit. This was because the amount of retransferred toner and external additive entering in the development device 4 was larger in a downstream image forming unit than in an upstream image forming unit, causing a more considerable carrier deterioration and degradation of charging property in the development device 4.

Experimental Example 2

Table 2 describes the evaluation results in the case where the ratio of carrier contained in the replenishing developer for each color of yellow, magenta, cyan, and black was set to 10%, 11%, 12%, and 13%, respectively. Table 2 describes detailed results with respect to toner fogging, toner scattering, granularity level, and toner charge amount degradation ratio after six hundred thousand full color images of image ratio of 10% had been formed.

TABLE 2

| | Image forming unit | | | |
|---|---|---|---|---|
| | Y | M | C | Bk |
| Fogging reflection ratio | 1.7% (OK) | 1.7% (OK) | 1.8% (OK) | 1.8% (OK) |
| Scattering level | ○ | ○ | ○ | ○ |
| Granularity | ○ | ○ | ○ | ○ |
| Amount of charge of toner variation ratio (—) | 7% | 7% | 7% | 7% |

As described in Table 2, in the case of the experimental example 2, with respect to the toner fogging, toner scattering, and granularity level (uneven toner) for all the image forming units 1 were maintained to a sufficient level not affecting the amount of charge of toner and the image quality after the life of the development device 4 of six hundred thousand images.

The same effect can be achieved by setting the ratio of carriers in the replenishing developer for all the image forming units 1% to 13%. However, in this case, the carrier ratio in an upstream image forming unit is also made high, and thus the running cost of the image forming apparatus 100 may increase, which is not practical.

In the present exemplary embodiment, when the above-described ratio of carrier in the replenishing developer for each color was used and images having an image ratio of 10% were formed, no toner fogging, scattering, or uneven toner occurred in all the image forming units 1, through the life of the development device 4 of six hundred thousand images.

Meanwhile, the results of a case where the ratio of carrier in the replenishing developer for each color of yellow, magenta, cyan, and black was set to 10%, 10%, 12%, and 13% were evaluated. In this case, no toner fogging, scattering, or uneven toner occurred in all the image forming units 1, through the life of the development device 4 of six hundred thousand full color images of an image ratio of 3%. Table 3 describes the results of this case.

TABLE 3

| | Image forming unit | | | |
|---|---|---|---|---|
| | Y | M | C | Bk |
| Fogging reflection ratio | 1.4% (OK) | 1.8% (OK) | 1.8% (OK) | 1.7% (OK) |
| Scattering level | ○ | ○ | ○ | ○ |
| Granularity | ○ | ○ | ○ | ○ |
| Amount of charge of toner variation ratio (—) | 7% | 8% | 7% | 7% |

The results were obtained because the image ratio of the formed images was sufficiently low, and thus the amount of retransferred toner and retransferred external additive entering from the first image forming unit 1Y into the second image forming unit 1M was the level not affecting the toner in an actual use.

In this case also, with respect to the first, the third, and the fourth image forming units 1Y, 1C, and 1Bk, or with respect to the second, the third, and the fourth image forming units 1M, 1C, and 1Bk, the ratio of carrier in the replenishing developer is larger in a downstream image forming unit than in an upstream image forming unit. Accordingly, the phenomena of toner fogging, toner scattering, or uneven toner can be suppressed to a level not affecting the toner in a practical use, due to an effect achieved by the entire image forming unit 1.

In the image forming apparatus 100 employing both the cleanerless system and the automatic developer exchange system, the ratio of carrier contained in the replenishing developer in a downstream image forming unit was set to a level higher than that in an upstream image forming unit.

As a result, an image forming stable in a long period of time, in which deterioration of carriers was suppressed or sufficiently reduced for all the image forming units 1 even when the retransferred toner or external additive was mixed in the toner, was achieved without causing toner fogging, toner scattering, or uneven toner.

With a closer examination, the weight percent of the carrier in the replenishing developer can be set to a value ranging from 1 wt % to 40 wt %. When the weight percent of the carrier was set to a value below 1 wt %, the effect of the automatic developer exchange system was lost. If the weight percent of the carrier was set to a value above 40 wt %, the ratio of toner in the replenishing developer stored in the toner container becomes too low.

Accordingly, if images having a high image ratio are serially formed, the toner replenishing operation cannot be performed at an appropriate timing. In addition, if a very large amount of replenishing carrier is replenished in an amount exceeding the carrier discharge amount, the developer in the development device 4 may be oversaturated.

Furthermore, in this case, charging of the toner started in the toner bottle, and thus an overcharged toner was replenished. Accordingly, since the replenishment is performed primarily to replenish the toner, the weight percent of the carrier in the replenishing developer can be set to 40 wt % or smaller, in terms of the toner replenishing amount.

In addition, the weight percent of the carrier in an upstream image forming unit (C (N) %) and the weight percent of the carrier in a downstream image forming unit (C(N+1) %) (the image forming units are adjacent to each other) can be set satisfying the following expression.

$$1<C(N+1)/C(N)\leqq 3.$$

The cost may increase if the ratio of carrier in the replenishing developer is very high. Thus, in the case where C(N+1)/C(N)>3, then the ratio of carrier in a downstream image forming unit becomes excessive, which may increase the cost.

In the case where it is necessary to replenish a large amount of toner as in developing a high density image, the replenishing developer in a downstream image forming unit has a low toner ratio. In this case, the toner cannot be replenished at an appropriate timing. It is found that the carrier deterioration can be effectively suppressed if the above-described expression is satisfied.

In the present exemplary embodiment, the configuration of the image forming apparatus 100 is not limited to that illustrated in FIG. 1. For example, an image forming apparatus employing a direct transfer method, in which no intermediate transfer member is used and a toner image is transferred directly from a photosensitive drum to a recording medium, can implement an exemplary embodiment.

The dimension, shape, material, and relative position of the above-described components of the image forming apparatus 100 according to the present exemplary embodiment are not limited to those described above unless otherwise described.

Second Exemplary Embodiment

Now, a second exemplary embodiment of the present invention will be described below. The image forming operations according to the second exemplary embodiment are substantially similar to those in the first exemplary embodiment. Accordingly, such operations similar to those in the first exemplary embodiment will not be described again in the present exemplary embodiment.

As illustrated in FIG. 6, in the case of forming a monochromatic image, the image forming units for other colors drive the photosensitive drum 2 only, and the development device 4, the charge roller 3, and the auxiliary charging device 6 are not operated. In this case, the retransferred toner and external additive transferred from an upstream image forming unit seldom enter the image forming unit 1Bk.

In this regard, in an image forming apparatus for users who frequently perform a printing of full color images, for example, the weight percent of carrier in the replenishing developer in a downstream image forming unit, with respect to the image forming units for each color in the first exemplary embodiment, can be increased.

On the other hand, in an image forming apparatus for users who frequently perform a printing of single (black) color images, for example, if the weight percent of carrier in the replenishing developer is made high in the image forming unit for the color of black as in the first exemplary embodiment, the carrier is exchanged too frequently. Thus, in this case, the cost becomes high.

In this regard, in the present exemplary embodiment, the following operation is performed for an apparatus for a user who frequently performs a monochromatic image forming operation. That is, the weight percent of carrier in the replenishing developer in the image forming unit for the color of black is not necessarily increased to a value higher than the weight percent of carrier in the replenishing developer in an upstream image forming unit, in the case where image forming units for yellow, magenta, and cyan are disposed on an upstream side of the image forming unit for black. A detailed description thereof will be made below.

Experimental Example 3

In an experimental example 3, an image forming apparatus for a user who frequently performs an image forming operation of a monochromatic image but does not so many times perform an image forming operation of color images is supposed. With respect to the state of use of the image forming apparatus 100 by the user, it is supposed that the ratio of performance of the full color image forming operation and the monochromatic image (of the single color of black) forming operation is 2:8.

The ratio of carrier in the replenishing developer for each color of yellow, magenta, cyan, and black was set to 10%, 11%, 12%, and 11%. The toner fogging, toner scattering, granularity level, and toner charge degradation ratio were evaluated in the case where six hundred thousand images having an image ratio of 10% had been formed with each image forming unit at the ratio of performance of the full color image forming operation and the monochromatic image (of the single color of black) forming operation which is 2:8. Table 4 describes the results of this case.

TABLE 4

| | Image forming unit | | | |
|---|---|---|---|---|
| | Y | M | C | Bk |
| Fogging reflection ratio | 1.7% (OK) | 1.7% (OK) | 1.8% (OK) | 1.8% (OK) |
| Scattering level | ○ | ○ | ○ | ○ |
| Granularity | ○ | ○ | ○ | ○ |
| Amount of charge of toner variation ratio (—) | 7% | 7% | 7% | 7% |

As described in Table 4, in the case of the experimental example 3, the toner fogging, toner scattering, and granularity level (uneven toner) for all the image forming units 1 were maintained to a sufficient level not affecting the amount of charge of toner and the image quality after the life of the development device 4 of six hundred thousand images.

Experimental Example 4

In an experimental example 4, an image forming apparatus for a user who performs an image forming operation at substantially the same ratio is supposed. With respect to the state of use of the image forming apparatus 100 by the user, it is supposed that the ratio of performance of the full color image forming operation and the monochromatic image (of the single color of black) forming operation is 1:1.

The ratio of carrier in the replenishing developer for each color of yellow, magenta, cyan, and black was set to 10%, 11%, 12%, and 12%. The toner fogging, toner scattering, granularity level, and toner charge degradation ratio were evaluated in the case where six hundred thousand images having an image ratio of 10% had been formed with each image forming unit at the ratio of performance of the full color image forming operation and the monochromatic image (of the single color of black) forming operation which is 1:1. Table 5 describes the results of this case.

TABLE 5

| | Image forming unit | | | |
|---|---|---|---|---|
| | Y | M | C | Bk |
| Fogging reflection ratio | 1.7% (OK) | 1.7% (OK) | 1.8% (OK) | 1.7% (OK) |
| Scattering level | ○ | ○ | ○ | ○ |
| Granularity | ○ | ○ | ○ | ○ |
| Amount of charge of toner variation ratio (—) | 7% | 7% | 7% | 7% |

As described in Table 5, in the case of the experimental example 4, the toner fogging, toner scattering, and granularity level (uneven toner) for all the image forming units 1 were maintained to a sufficient level not affecting the amount of charge of toner and the image quality after the life of the development device 4 of six hundred thousand images.

The image forming apparatus for a user who frequently performs a monochromatic image forming (of the single color of black) has the following configuration.

The weight percent of carrier in the replenishing developer in the image forming unit for the color of black is not necessarily increased to a value higher than the weight percent of carrier in the replenishing developer in an upstream image forming unit, in the case where image forming units for yellow, magenta, and cyan are disposed on an upstream side of the image forming unit for black. In addition, with respect to the image forming units for yellow, magenta, and cyan, the ratio of carrier in the replenishing developer is set to a higher value in a downstream image forming unit than that in an upstream image forming unit.

Accordingly, in the image forming apparatus 100 employing both the cleanerless system and the automatic developer exchange system, the following effects can be achieved.

That is, the carrier deterioration can be effectively suppressed in all the image forming units in the case where the retransferred toner or external additive is mixed in the toner, without increasing the ratio of carrier in the replenishing developer in the image forming unit for black to a very high value. As a result, an image forming operation stable in a long period of time can be achieved without causing toner fogging, toner scattering, or uneven toner.

Third Exemplary Embodiment

Now, a third exemplary embodiment of the present invention will be described below. The image forming operations according to the third exemplary embodiment are substantially similar to those in the first and the second exemplary embodiments. Accordingly, such operations similar to those in the first and the second exemplary embodiments will not be described again in the present exemplary embodiment.

The image forming apparatus 100 according to the first and the second exemplary embodiments employs the cleanerless system for all of the image forming units for yellow, magenta, cyan, and black. In the present exemplary embodiment, the image forming unit for black only has a cleaning mechanism for the photosensitive drum 2.

Furthermore, the ratio of carrier in the replenishing developer for the image forming unit for black, which has the cleaning mechanism, is set lower than those for the cleanerless image forming units. Moreover, with respect to the cleanerless image forming units for other colors, the ratio of carrier in the replenishing developer for a downstream image forming unit is set to a value higher than that for an upstream image forming unit. Details of this configuration will be described below.

In the present exemplary embodiment, the image forming unit for black only has a cleaning mechanism for the photosensitive drum 2. Accordingly, the amount of contamination with the residual transfer toner or the external additive is substantially reduced. Thus, the ratio of carrier in the replenishing developer for the image forming unit for black can be set lower than those for the cleanerless image forming units for other colors.

In the present exemplary embodiment, it is supposed that the user frequently performs a monochromatic image (single color of black) forming operation. In this regard, the photosensitive drum 2 for the image forming unit for black is made of an amorphous silicon, in order to elongate the life of the photosensitive drum 2 for the image forming unit for black.

An amorphous silicon photosensitive drum is excellent in the abrasive resistance compared to the organic photosensitive drum described in the first exemplary embodiment. However, in the case of using an amorphous silicon photosensitive drum, a phenomenon of image deletion may occur due to the high abrasive resistance. In this regard, the amorphous silicon photosensitive drum is provided with a cleaner blade. With the cleaner blade, corona effluences on the surface of the photosensitive drum 2 can be effectively removed.

The life of the organic photosensitive drum according to the present exemplary embodiment is ten thousand images. The life of the amorphous silicon photosensitive drum according to the present exemplary embodiment is five hundred thousand images.

Figure 9:
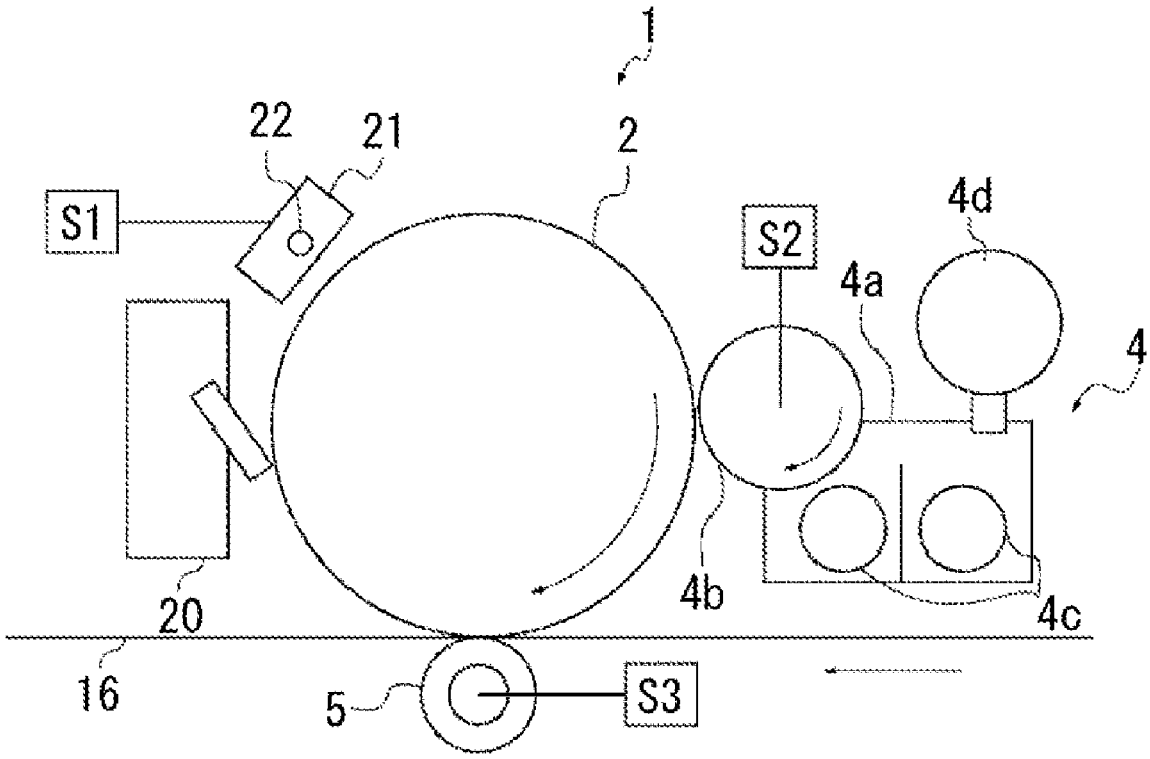
FIG. 9 illustrates an exemplary configuration of an image forming unit for black according to a third exemplary embodiment of the present invention.

The image forming unit for black according to the present exemplary embodiment will be described in detail below with reference to FIG. 9. The development device 4 has a similar configuration as those in the first and the second exemplary embodiments, and accordingly, the description thereof is not repeated here.

The image forming unit for black according to the present exemplary embodiment uses a scorotron type corona discharging device as a charging device 21. The corona discharging device is made by covering a discharge wire 22 with a metal shield whose side opposing the photosensitive drum 2 has an aperture.

The image forming unit for black according to the present exemplary embodiment further includes a cleaning device 20. The cleaning device 20 removes the residual transfer toner remaining on the photosensitive drum 2 after the primary transfer. As the photosensitive drum 2 for the image forming unit for black, an amorphous silicon photosensitive drum is used.

Experimental Example 5

In the present exemplary embodiment, as described above, the image forming unit for black only has the cleaning device 20. Accordingly, the level of contamination with the carrier occurring due to the residual transfer toner or external additive is reduced to a sufficiently low level. Accordingly, in an experimental example 5, the ratio of carrier in the replenishing developer for the image forming unit for black is set to a value smaller than those for the cleanerless image forming units for other colors. More specifically, the ratio of carrier in the replenishing developer for each color of yellow, magenta, cyan, and black was set to 10%, 11%, 12%, and 9%. The toner fogging, toner scattering, granularity level, and toner charge degradation ratio were evaluated in the case where six hundred thousand images having an image ratio of 10% had been formed with each image forming unit. Table 6 describes the results of this case.

TABLE 6

| | Image forming unit | | | |
|---|---|---|---|---|
| | Y | M | C | Bk |
| Fogging reflection ratio | 1.7% (OK) | 1.7% (OK) | 1.8% (OK) | 1.8% (OK) |
| Scattering level | ○ | ○ | ○ | ○ |
| Granularity | ○ | ○ | ○ | ○ |
| Amount of charge of toner variation ratio (—) | 7% | 7% | 7% | 7% |

As described in Table 6, in the case of the experimental example 5, the toner fogging, toner scattering, and granularity level (uneven toner) for all the image forming units 1 were maintained to a sufficient level not affecting the amount of charge of toner and the image quality after the life of the development device 4 of six hundred thousand images.

As described above, in the present exemplary embodiment, the weight percent of carrier in the replenishing developer in the image forming unit having the photosensitive drum 2 including the cleaning device 20 is set to a value smaller than the weight percent of carrier in the replenishing developer for the cleanerless image forming units. Furthermore, with respect to the image forming units for other colors (yellow, magenta, and cyan), the ratio of carrier in the replenishing developer in a downstream image forming unit is set to a value higher than that in an upstream image forming unit.

Accordingly, the carrier deterioration can be effectively suppressed in all the image forming units without increasing the ratio of carrier in the replenishing developer in the image forming unit for black to a very high value. As a result, an image forming operation stable in a long period of time can be achieved without causing toner fogging, toner scattering, or uneven toner.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-248127 filed Sep. 13, 2006, which is hereby incorporated by reference herein in its entirety.

What is claimed is:

1. An image forming apparatus comprising:

a first image forming unit and a second image forming unit each including an image bearing member configured to bear an electrostatic image, a charging device configured to charge the image bearing member, and a development device configured to develop the electrostatic image with a developer including a mixture of toner and carrier;

a transfer device configured to serially transfer toner images formed on the respective image bearing members of the first image forming unit and the second image forming unit onto a transfer medium, wherein the second image forming unit is disposed on a downstream side of the first image forming unit in a direction of travel of the transfer medium, and wherein each of the development devices of the first image forming unit and the second image forming unit is configured to recover a residual transfer toner remaining on each of the image bearing members;

a replenishment device configured to replenish a replenishing developer including a mixture of toner and carrier to each of the development devices; and a discharge device configured to discharge the developer from each of the development devices, wherein a weight percent of carrier in the replenishing developer to be replenished to the development device of the second image forming unit is larger than a weight percent of carrier in the replenishing developer to be replenished to the development device of the first image forming unit.

2. The image forming apparatus according to claim 1, wherein the weight percent of carrier in the replenishing developer to be replenished to the development device of the first image forming unit (C(N) %) and the weight percent of carrier in the replenishing developer to be replenished to the development device of the second image forming unit (C(N+1) %) satisfy the following expression:

$$1<C(N+1)/C(N)\leqq 3.$$

3. The image forming apparatus according to claim 1, wherein each of the first image forming unit and the second image forming unit further includes an auxiliary charging device configured to charge the residual transfer toner.

4. The image forming apparatus according to claim 1, further comprising a plurality of image forming units in addition to the first image forming unit and the second image forming unit, wherein one of the plurality of image forming units is configured to form a toner image using a black toner, and wherein each of the first image forming unit and the second image forming unit uses a toner of color other than black.

5. The image forming apparatus according to claim 1, wherein the weight percent of carrier in the replenishing developer ranges from one weight percent to 40 weight percent inclusive.

6. The image forming apparatus according to claim 1, further comprising:

a first developer container configured to contain the replenishing developer to be replenished to the development device of the first image forming unit, the first developer container being detachably mounted in the image forming apparatus; and a second developer container configured to contain the replenishing developer to be replenished to the development device of the second image forming unit, the second developer container being detachably mounted in the image forming apparatus.

* * * * *